US008137123B2

(12) United States Patent
Sakamoto

(10) Patent No.: US 8,137,123 B2
(45) Date of Patent: Mar. 20, 2012

(54) CONNECTOR FOR PREVENTING TERMINAL INSERTION IN THE TERMINAL INSERT HOLE

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/088,648

(22) Filed: Apr. 18, 2011

(65) Prior Publication Data

US 2011/0256751 A1 Oct. 20, 2011

(30) Foreign Application Priority Data

Apr. 20, 2010 (JP) ..... 2010-097364

(51) Int. Cl.
*H01R 13/625* (2006.01)

(52) U.S. Cl. ..... 439/345

(58) Field of Classification Search ..... 439/345, 439/352, 468, 953, 76.1, 369
See application file for complete search history.

(56) References Cited

U.S. PATENT DOCUMENTS 4,426,127 A * 1/1984 Kubota ..... 439/607.17
6,971,898 B2 * 12/2005 Ostendorp ..... 439/301
7,281,324 B2 * 10/2007 Kent et al. ..... 29/846
7,661,981 B2 * 2/2010 Cross et al. ..... 439/468
7,789,690 B1 * 9/2010 Rhein ..... 439/310

FOREIGN PATENT DOCUMENTS

JP 5-258795 A 10/1993
JP 2008-65985 A 3/2008

* cited by examiner

*Primary Examiner* — Jean F Duverne
(74) *Attorney, Agent, or Firm* — Sughrue Mion, PLLC

(57) ABSTRACT

Terminal insert holes 61 are provided in a spacer 60 inserted into an inner housing. In each of the terminal insert holes 61, a lance 62 is provided. The lance is arranged in an obliquely upper position relative to the vertical direction and the transverse direction seen from, a central part of the terminal insert hole 61. A bending direction of each lance is set to a direction substantially corresponding to the oblique direction. Further, in the spacer 60, an engaging protrusion part 63 is provided as a mainly terminal engaging part. Thus, the spacer is pushed in to a mainly engaged position from a temporarily engaged position to shift a temporary engagement by the lance to a main engagement by the engaging protrusion part. In an end part of an engaging edge part 63*a* of the engaging protrusion part 63, an inclined surface 63*c* is provided. The inclined surface is allowed to abut on a rotating direction position control part 84 of a terminal 80 to easily rotate the terminal by pushing the spacer.

3 Claims, 24 Drawing Sheets

DURING PRIMARY ENGAGEMENT

DURING SECONDARY ENGAGEMENT

DURING SECONDARY ENGAGEMENT

DURING PRIMARY ENGAGEMENT

DURING PRIMARY ENGAGEMENT

DURING PRIMARY ENGAGEMENT

DURING SECONDARY ENGAGEMENT

CONNECTOR FOR PREVENTING TERMINAL INSERTION IN THE TERMINAL INSERT HOLE

BACKGROUND OF THE INVENTION

1. Field of the Invention

The present invention relates to a connector that prevents a terminal inserted into a terminal insert hole from a rear part from slipping out by a flexible lance provided so as to face an inner space of the terminal insert hole.

2. Description of the Related Art

Usually, in most of connectors used for a vehicle, square terminal insert holes are ordinarily formed in connector housings as shown in patent literature 1, and square terminals having square electric connecting parts in their front parts are respectively inserted into the terminal insert holes. When the square terminal is used, a directional performance or orientation of the terminal on an axis needs to be recognized during an insertion of the terminal into the terminal insert hole. However, with the progress of a miniaturization of the connector, when the terminal is designed to be miniaturized, as the terminal is smaller, it is the more difficult to recognize the directional performance or orientation of the terminal during the insertion of the terminal.

As compared therewith, an example of a connector using a round terminal using a cylindrical electric wire connecting part is disclosed in, for instance, patent literature 2. In this connector, a lance of a connector housing side is engaged with a rear end of the cylindrical electric connecting part of the round terminal. Thus, the terminal can be inserted into a terminal insert hole without caring about the directional performance or orientation.

Patent literature 1: JP-A-2008-65985

Patent literature 2: JP-A-5-258795

However, even when the round terminal is used, a directional performance or orientation to a terminal of a mate side connector may occasionally need to be ensured. For instance, when a male tab terminal of the mate side connector is received by the electric connecting part of the round terminal to ensure a contact pressure between the terminals by a leaf spring incorporated in the electric connecting part, the round terminal needs to be attached to a connector housing so as to be properly oriented to the male tab terminal of the mate side connector.

However, when the terminal is miniaturized, it is very difficult not only for the square terminal, but also for the round terminal to recognize the directional performance or orientation and attach the terminal to the connector housing at the same time.

Thus, a request is raised that when the terminal is inserted into the terminal insert hole of the connector housing, the terminal can be inserted into the terminal insert hole without caring about the directional performance or orientation, and then, after all the terminals are completely inserted into the terminal insert holes, the directional performance or orientation of the terminals is desired to be uniformly corrected by using an easiness in rotation peculiar to the round terminal.

SUMMARY OF THE INVENTION

The present invention is devised by considering the above-described circumstances, and it is an object of the present invention to provide a connector that can simply unify the directional performance of a terminal by using a round terminal even when the terminal is miniaturized or has multipoles In order to solve the above-described problems, a connector of the invention defined in a first aspect of the invention includes: a connector housing having terminal insert holes extending forward and backward; and terminals respectively inserted into the terminal insert holes of the connector housing from a rear part, a flexible lance being provided in each of the terminal insert holes of the connector housing to prevent the terminal slipping out rearward when the terminal is inserted into each terminal insert hole from the rear part, and is characterized in that the connector housing includes a connector housing main body having the terminal insert holes composed of circular holes and a spacer insert recessed part formed from an outer peripheral surface to an inner part and a spacer that can be inserted into the spacer insert recessed part of the connector housing main body in a direction intersecting an inserting direction of the terminal, has a temporarily engaging unit which is temporarily engaged with the connector housing main body under an inserted state and a mainly engaging unit which is mainly engaged with the connector housing main body, has terminal insert holes corresponding to the terminal insert holes of the connector housing main body and has a mainly terminal engaging part which permits the terminal to be inserted into the terminal insert hole at a temporarily engaged position where an insertion to the spacer insert recessed part is shallow and is mainly engaged with the terminal at a mainly engaged position where an insertion to the spacer insert recessed part is deep to prevent the terminal from moving forward and backward, in the spacer, the lance is integrally provided as a temporarily terminal engaging unit that is temporarily engaged with the terminal when the terminal is inserted into the terminal insert hole from a rear part under a state that the spacer is located at the temporarily engaged position, the mainly terminal engaging part is provided, in an inner periphery of the terminal insert hole of the spacer, as an engaging protrusion part fitted to an engaging recessed part of the terminal side at a position of a front side of the inserting direction when the spacer is inserted into the spacer insert recessed part, an engaging edge part of the engaging protrusion part is provided as an edge part substantially parallel to a direction orthogonal to the inserting direction of the spacer, the lance is arranged, in the inner periphery of the terminal insert hole of the spacer, at a position shifted from a position of a front surface opposed to the engaging protrusion part in an oblique direction seen from a central part of the terminal insert hole, a bending direction of the lance is set to a direction substantially corresponding to the oblique direction, an engaging edge part of the lance fitted to the engaging recessed part of the terminal side is provided as an edge part orthogonal to the bending direction of the lance, the terminal is formed as a round terminal having a cylindrical electric connecting part fitted and connected to a terminal of a mate connector side, in a rear part of the cylindrical electric connecting part of the round terminal, an engaging part is provided that is engaged with the lance and the engaging protrusion part and positions a rotating direction of the terminal during a process of engagement, in a further rear side, an electric wire connecting part is provided to which a terminal of a coated electric wire is connected, the engaging part of the terminal includes an engaging recessed part formed by recessing two opposed surfaces of a cylindrical periphery wall forming the electric connecting part substantially by the same dimension and a rotating direction position control part with a substantially rectangular shape in section having, as short sides, the cylindrical periphery wall remaining at a position where the engaging recessed part is formed and, as long sides, an inner bottom surface of the engaging recessed part, the engaging recessed part is provided to which the engaging edge part of the lance and the engaging edge part of the engaging protrusion part of the spacer are fitted to prevent the terminal from moving forward and backward, the rotating direction position control part is provided to apply a rotation for controlling a position in a rotating direction to the terminal by a rotation moment generated by a contact pressure when the engaging edge part of the lance and the engaging edge part of the engaging protrusion part of the spacer are pressed to come into contact therewith, and at least one end part of the engaging edge part of the engaging protrusion part of the spacer, an oblique cut-out part is provided to form an inclined surface that inclines a direction of force when the contact pressure is applied to the rotating direction position control part relative to the inserting direction of the spacer.

A connector defined in a second aspect of the invention is characterized, in the connector according to the first aspect of the invention, in that many terminal insert holes of the connector housing are arranged in the vertical direction and the transverse direction of the connector housing, the spacer insert recessed part of the connector housing main body is formed in such a direction as to insert the spacer upward from a lower surface of the connector housing main body, in each of the terminal insert holes of the spacer, the engaging protrusion part is arranged in a lower side and the lance is arranged in an obliquely upper position in the inner periphery of the terminal insert hole, and the inclined surface is formed in at least one end part in the transverse direction of the engaging edge part of the engaging protrusion part of the spacer.

A connector defined in a third aspect of the invention is characterized, in the connector according to the second aspect of the invention, in that when the arrangement of the terminal insert holes in the transverse direction is referred to as a line, the terminal insert holes are arranged with pitches fixed between the lines in the vertical direction and linearly arranged with the fixed pitches in the transverse direction in each of the lines in the vertical direction, and between the adjacent lines in the vertical direction, positions of the terminal insert holes are shifted by 1/integer times as long as an arrangement pitch in the transverse direction.

According to the invention defined in the first aspect of the invention, under a state that the spacer is inserted into the spacer insert recessed part of the connector housing main body and temporarily engaged therewith, the terminal is inserted into the terminal insert hole 25 from the rear part. Under this state, when the spacer is inserted into the mainly engaged position, the terminal can be assuredly prevented from slipping out by the engagement of the engaging protrusion part provided in the spacer with the engaging recessed part of the round terminal. At that time, by an operation for inserting the spacer into the mainly engaged position from the temporarily engaged position, the rotating direction position control part of the terminal whose orientation is not proper can be pressed by the engaging edge part of the engaging protrusion part of the spacer. The rotation moment necessary for controlling the position of the rotating direction can be applied to the terminal by the contact pressure due to the pressure contact. Accordingly, only when the spacer is inserted into the mainly engaged position, the orientation of the terminals can be unified.

Occasionally, depending on the orientation (the position in the rotating direction) of the rotating direction position control part having the substantially rectangular shape in section, the engaging part of the terminal may be possibly sandwiched between a bending resistance (an elastic reaction force) of the lance and an inserting force of the spacer so that the effective rotation moment is not applied to the rotating direction position control part. For instance, since the engaging edge part of the engaging protrusion part of the spacer is provided as an edge part vertical to the inserting direction of the spacer, the contact pressure applied to the rotating direction position control part from the engaging edge part is exerted in a direction parallel to the inserting direction of the spacer. Accordingly, depending on the orientation of the rotating direction position control part, a large rotation moment may not be possibly generated owing to a relation between a direction to which the contact pressure is applied and a center of rotation of the terminal (a center of a section of the electric connecting part of the terminal). In such a case, the inserting force of the spacer needs to be more increased to increase the rotation moment. Especially, when there are many round terminals, the spacer is hardly attached.

As compared therewith, in the connector of the present invention, the inclined surface is provided in the end part of the engaging edge part of the engaging protrusion part and a direction of a force when the contact pressure is applied to the rotating direction position control part of the terminal is inclined relative to the inserting direction of the spacer. Accordingly, a direction to which the contact pressure is applied can be directed to a direction effective for generating the rotation moment. Thus, even a small spacer inserting force can give a large turning force or torque for correcting the position in the rotating direction to the terminal and can easily and uniformly correct the direction of the terminal so as to have a uniform orientation. Therefore, an attaching performance can be improved.

Further, according to the present invention, since the spacer that is mainly engaged with the inserted terminal is provided integrally with the lances as the temporarily terminal engaging units, under a state that the individual terminals are respectively temporarily engaged with the lances, the spacer is inserted to the mainly engaged position, so that all the terminals can be mainly engaged with the mainly terminal engaging parts provided in the spacer at the same time. Accordingly, assembly workability is improved and the terminals can be assuredly fixed.

Further, in the present invention, since the engaging edge part of the engaging protrusion part and the engaging edge part of the lance of the spacer are fitted to the engaging recessed part of the terminal and further, the engaging edge part of the engaging protrusion part and the engaging edge part of the lance of the spacer are pressed to come into contact with the rotating direction position control part of the terminal, the position in the rotating direction of the round terminal which is inserted without caring about the orientation during the temporary engagement of the lance can be corrected to a position suitable for the lance. As described above, when the spacer is pushed in to the mainly engaged position during a shift from the temporarily engaged state to the mainly engaged state, the terminal can be corrected to a proper engaged position by a pushing operation of the spacer. Thus, even when the round terminal is used, the terminal can be automatically positioned to a proper position and assembled in a final assembly stage.

According to the invention defined in the second aspect of the invention, many terminal insert holes of the connector housing are arranged in the vertical direction and the transverse direction of the connector housing. The spacer insert recessed part of the connector housing main body is formed in such a direction as to insert the spacer upward from the lower surface of the connector housing main body. In each of the terminal insert holes of the spacer, since the engaging protrusion part is arranged in a lower position of an inner periphery of the terminal insert hole and the lance is arranged in the obliquely upper position, blank spaces between the plurality of terminal insert holes are effectively used and the lances can be arranged or the bending spaces of the lances can be ensured. Accordingly, the terminals can be densely arranged, which can contribute to the miniaturization or the multi-polar form of the connector.

According to the invention defined in the third aspect of the invention, since the positions of the terminal insert holes in the transverse direction are shifted between adjacent upper and lower lines, the blank spaces between the terminal insert holes are effectively used and many terminal insert holes can be densely arranged in the vertical direction. Accordingly, the terminals can be more densely arranged, so that the connector can be more miniaturized or the connector can have a more multi-polar form. Further, since an amount of shift of the terminal insert holes in the transverse direction between the adjacent upper and lower lines is set to 1/integer times as long as the pitch between the terminals in the transverse direction, the positions of the terminal insert holes can be allowed to mutually correspond in the transverse direction between the lines spaced by lines of an inverse number of 1/integer.

For instance, when the positions of the terminal insert holes in the transverse direction are shifted by ½ times as long as the arrangement pitch between the adjacent upper and lower lines, the positions of the terminal insert holes in the transverse direction can be allowed to mutually correspond on every other line in the vertical direction. Further, when the positions of the terminal insert holes in the transverse direction are shifted by ⅓ times as long as the arrangement pitch between the adjacent upper and lower lines, the positions of the terminal insert holes can be allowed to mutually correspond in the transverse direction at intervals of two lines in the vertical direction. Accordingly, a prescribed regularity can be provided irrespective of a zigzag arrangement.

Especially, when the terminal insert holes are arranged by shifting them by ⅓ times as long as the pitch between the adjacent lines, since the lances can be reasonably arranged in the blank spaces between the terminal insert holes in the upper line, the pitches between the terminal insert holes can be reduced and the terminals can be densely arranged, which can greatly contribute to the miniaturization and the multi-polar form of the connector.

BRIEF DESCRIPTION OF THE DRAWINGS

FIGS. 11(*a*) to 11(*c*) show states that angles of an engaging edge part of a lance relative to an engaging edge part of an engaging protrusion part are larger in order as shown by θ1 to θ3.

FIG. 12(*a*) is a perspective view showing an entire structure of the round terminal and FIG. 12(*b*) is a front view of a cylindrical box part located in a front part of the round terminal.

FIG. 13(*a*) is a front view and FIG. 13(*b*) is a sectional view taken along a line A-A in FIG. 13(*a*).

FIG. 14(*a*) is a front view and FIG. 14(*b*) is a sectional view taken along a line A-A in FIG. 14(*a*).

FIG. 15(*a*) is a diagram showing a state that the round terminal is primarily engaged (temporarily engaged) with a lance of the spacer and FIG. 15(*b*) is a diagram showing a state that the spacer is pressed to a mainly engaged position and the round terminal is secondarily engaged (mainly engaged) with the engaging protrusion part of the spacer.

FIG. 16(*a*) is a diagram showing a state that the round terminal is primarily engaged (temporarily engaged) with a lance of the spacer and FIG. 16(*b*) is a diagram showing a state that the spacer is pressed to a mainly engaged position and the round terminal is secondarily engaged (mainly engaged) with the engaging protrusion part of the spacer.

FIG. 17(*a*) is a diagram showing a relation between the round terminal and the lance when the round terminal is inserted in an arbitrary direction. FIG. 17(*b*) is a diagram showing a relation between the engaging part of the round terminal and the lance during a primary engagement (a temporary engagement).

FIG. 18(*a*) is a front view during the primary engagement. FIG. 18(*b*) is a front view showing a state that the spacer is pressed to the mainly engaged position from the temporarily engaged position so that a turning force or torque is applied to the round terminal. FIG. 18(*c*) is a front view during the secondary engagement.

FIG. 19(*a*) is a front view showing a relation between the lance during the primary engagement, the rotating direction position control part and the engaging edge part of the engaging protrusion part. FIG. 19(*b*) is a front view showing a stat that an inclined surface formed in an end part of the engaging edge part of the engaging protrusion part applies a rotation moment effective for a rotating direction position control to the round terminal in accordance with an inserting operation (a movement toward a direction shown by an arrow mark Y6) of the spacer from the temporarily engaged position to the mainly engaged position.

FIG. 20(*a*) is a front view showing a relation between a lance during a primary engagement, a rotating direction position control part and the engaging edge part of the engaging protrusion part. FIG. 20(*b*) is a state that a rotation moment effective for a rotating direction position control cannot be applied to a round terminal in accordance with an inserting operation of a pacer from a temporarily engaged position to a mainly engaged position.

DESCRIPTION OF THE PREFERRED EMBODIMENTS

Figure 1:
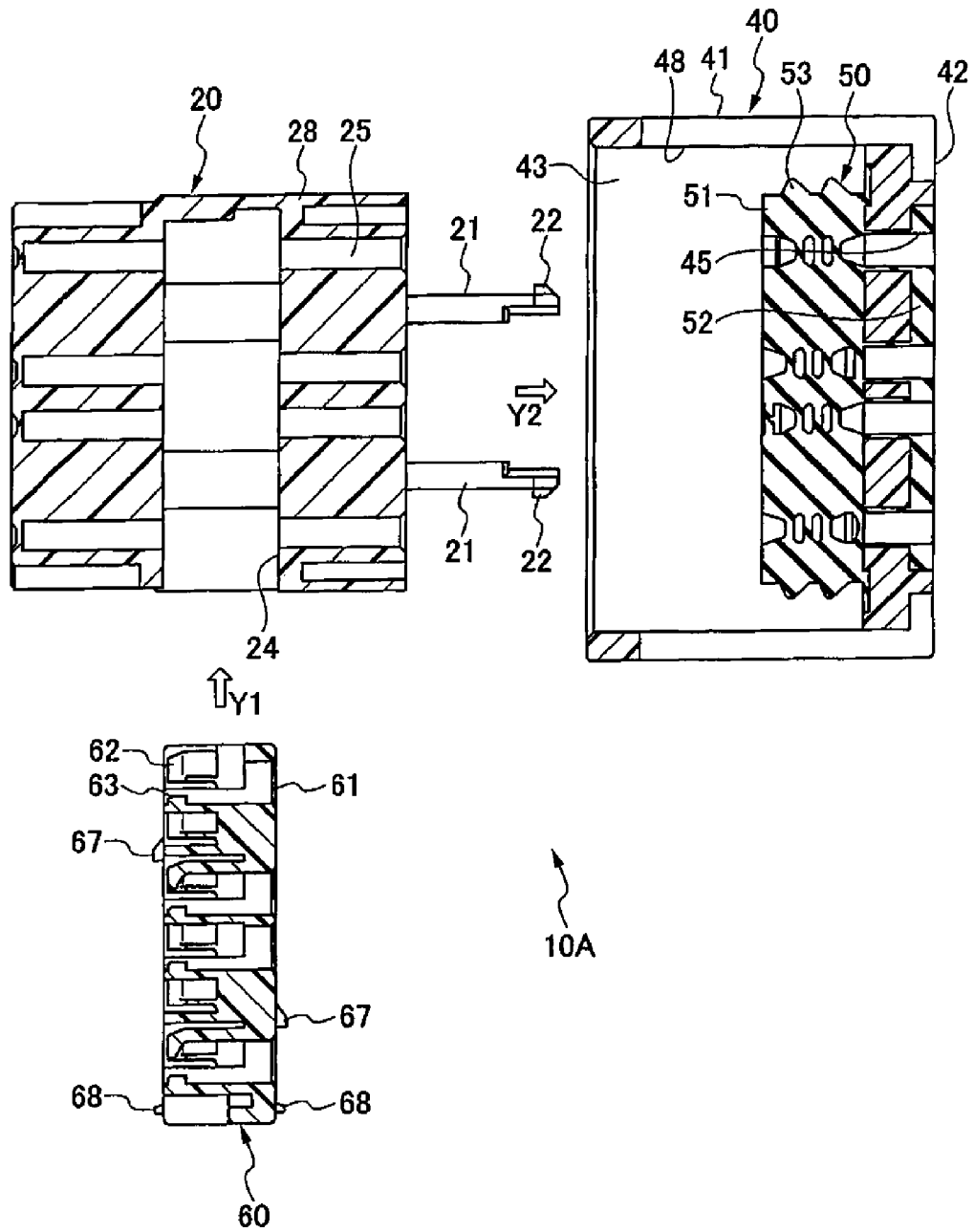
FIG. 1 is a side sectional view showing a relation between an inner housing (corresponding to a connector housing main body), an outer housing and a spacer which form a connector housing of a connector of an exemplary embodiment of the present invention.

Now, an exemplary embodiment of the present invention will be described below by referring to the drawings.

Figure 2:
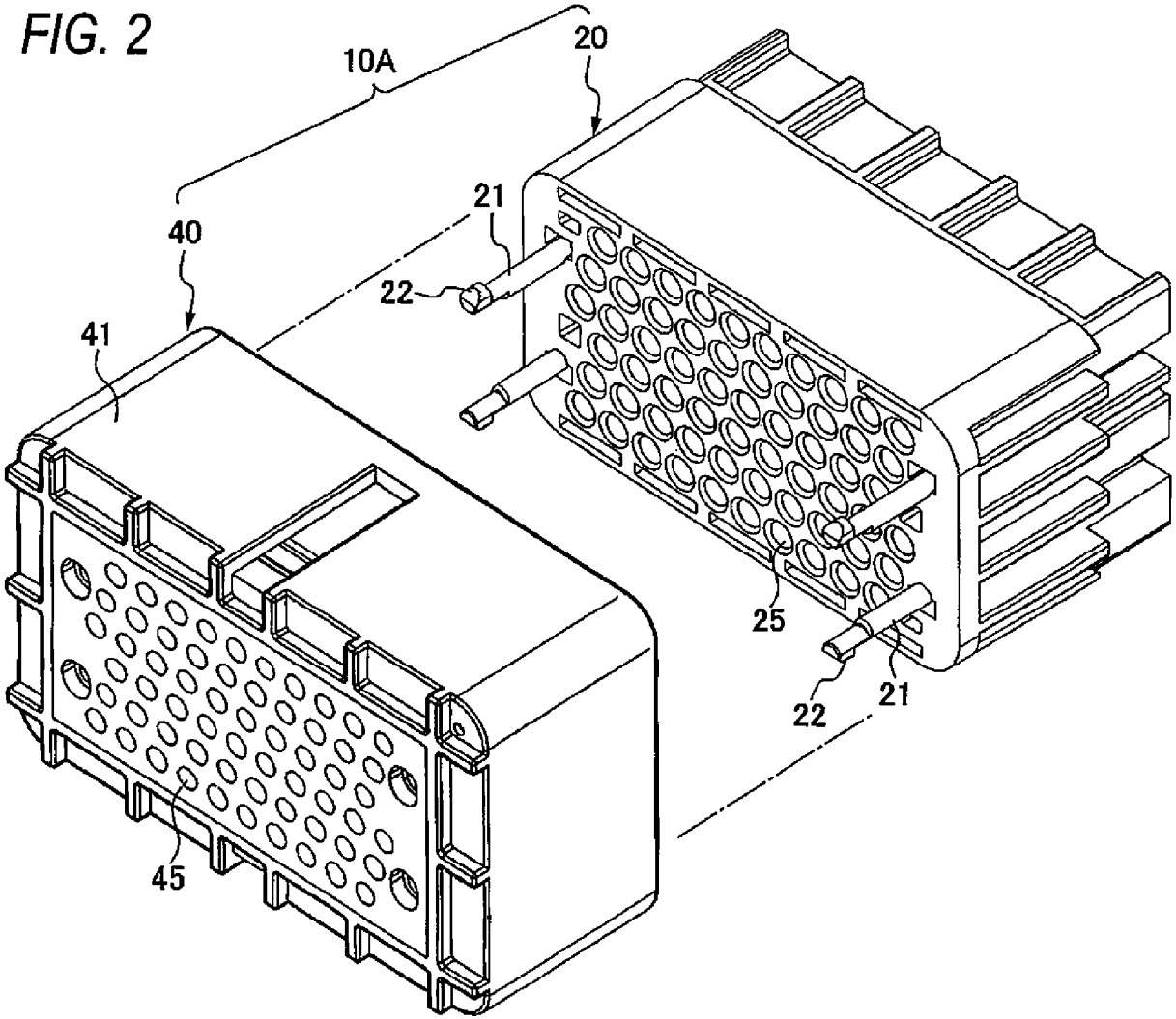
FIG. 2 is a perspective view showing a relation between the inner housing and the outer housing.
Figure 3:
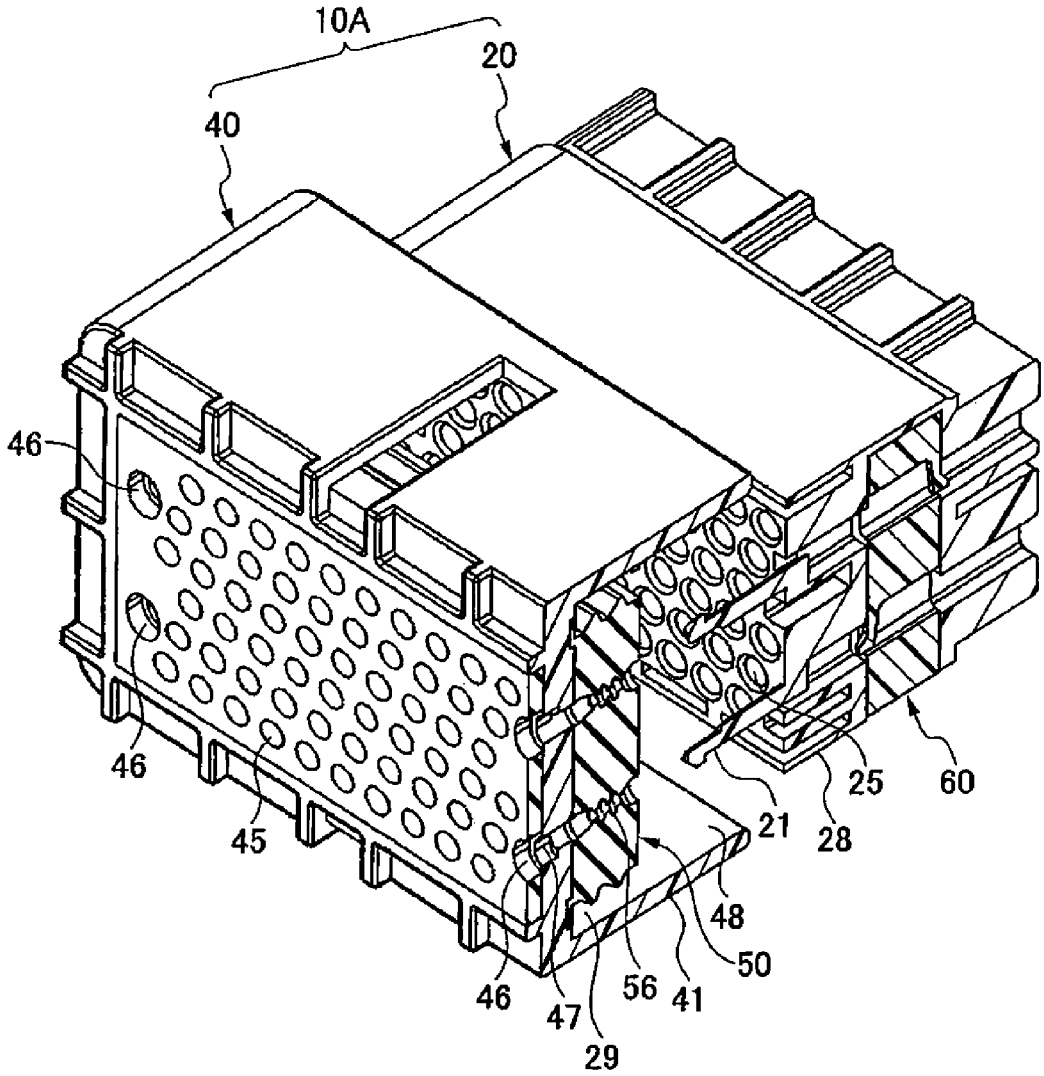
FIG. 3 is a partly broken perspective view showing the inner housing and the outer housing.
Figure 4:
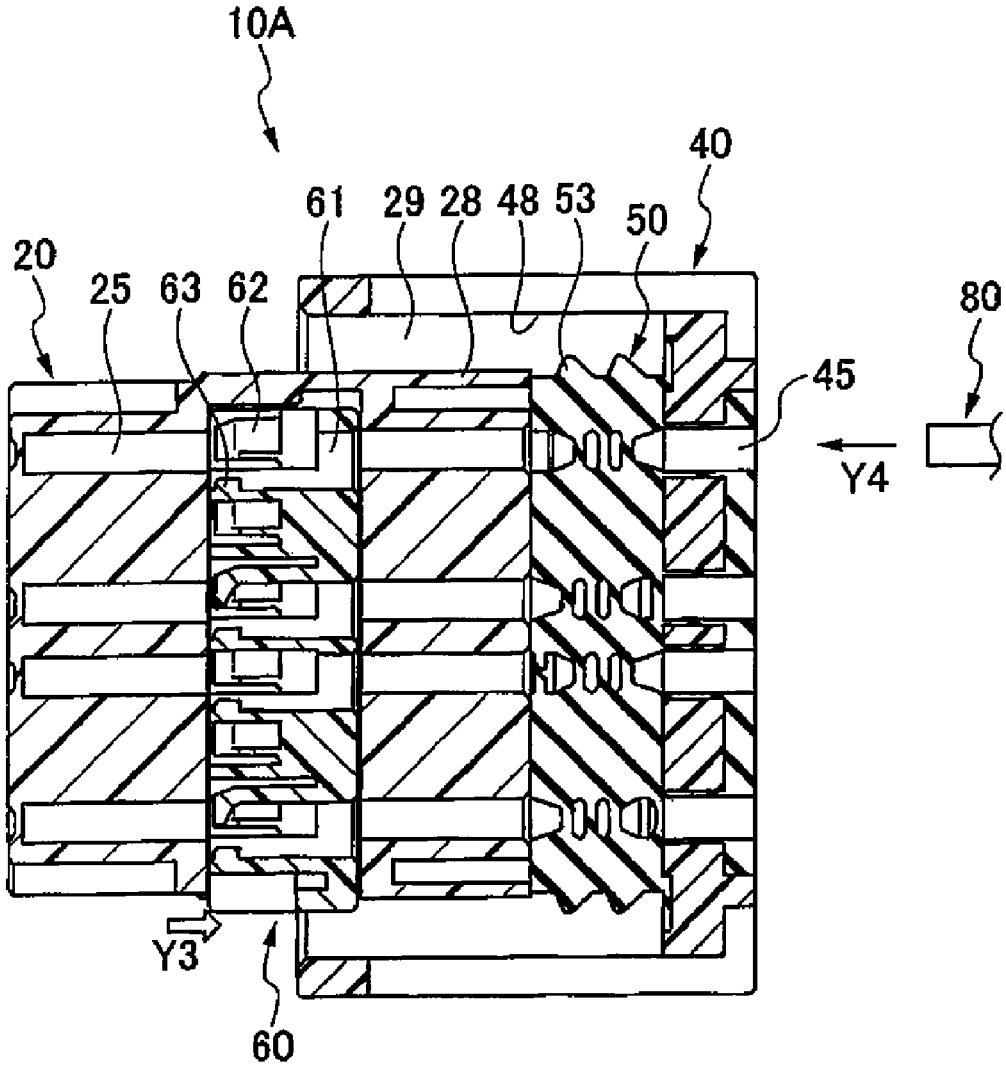
FIG. 4 is a side sectional view showing a state that the inner housing with which the spacer is temporarily engaged is attached to the outer housing.
Figure 5:
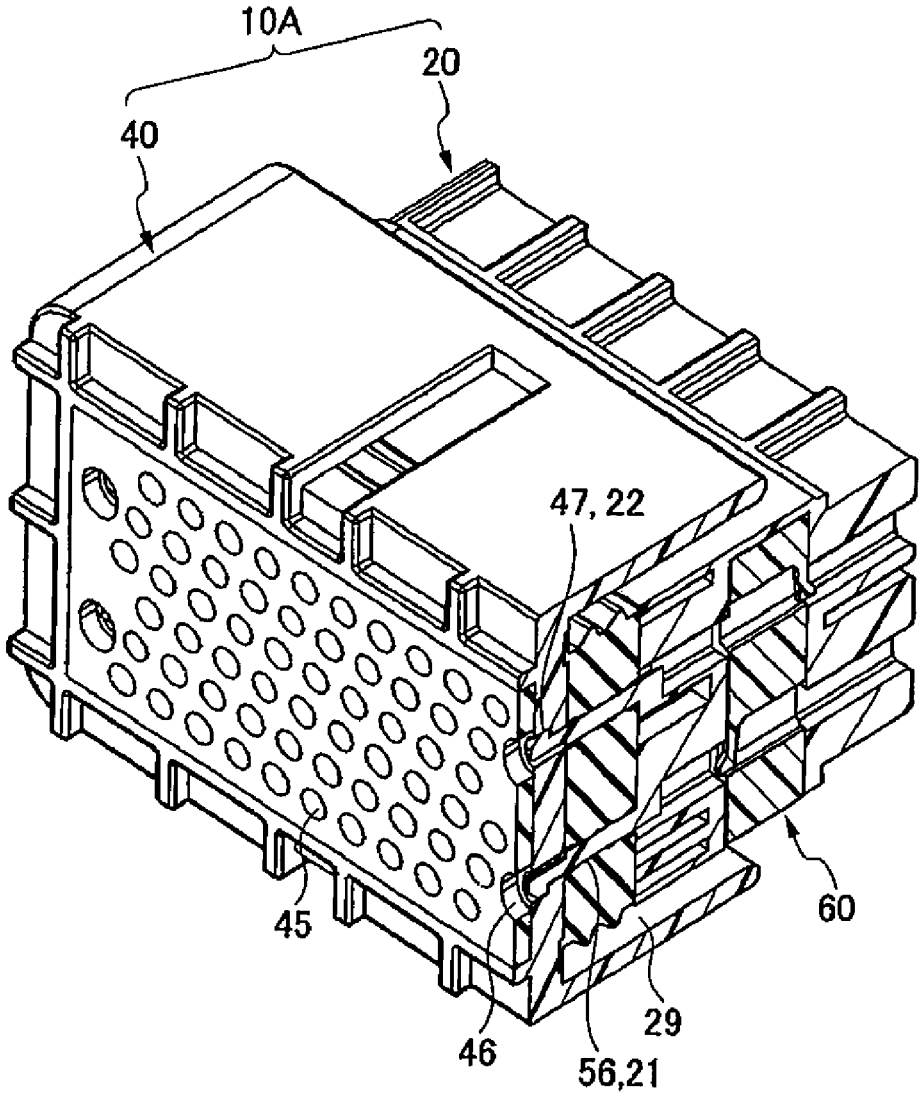
FIG. 5 is partly broken perspective view showing the state illustrated in FIG. 4.
Figure 6:
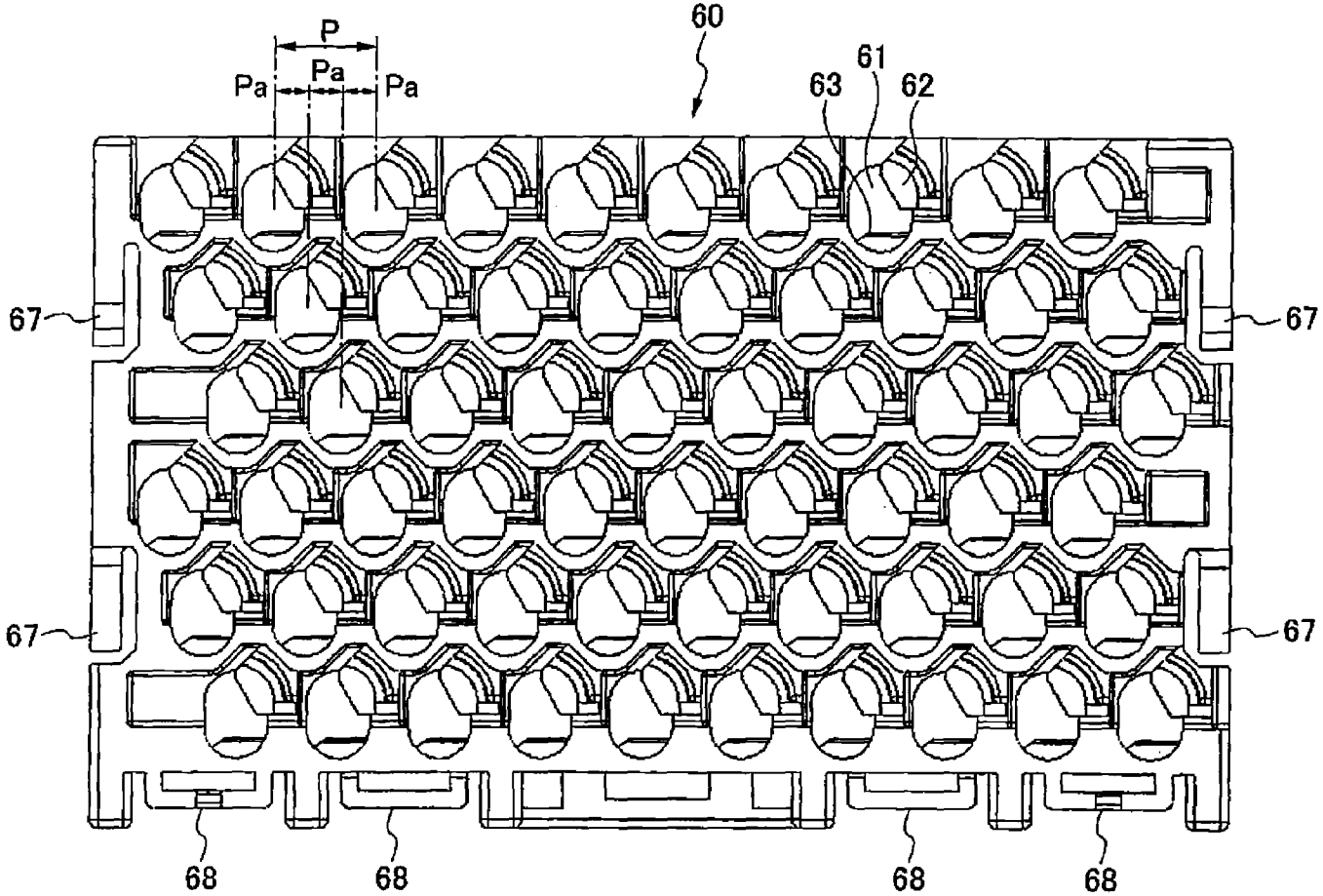
FIG. 6 is a front view of the spacer.
Figure 7:
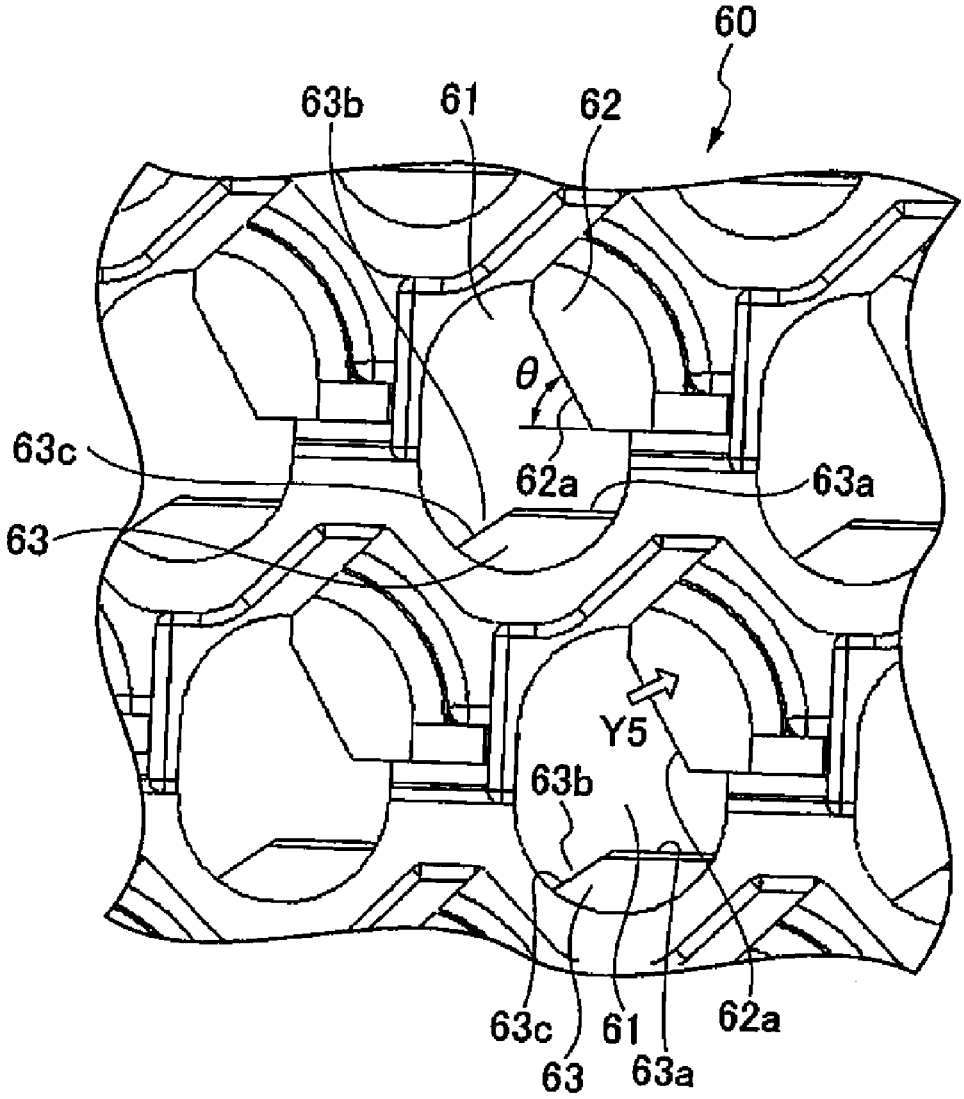
FIG. 7 is a partly enlarged view of FIG. 6.
Figure 8:
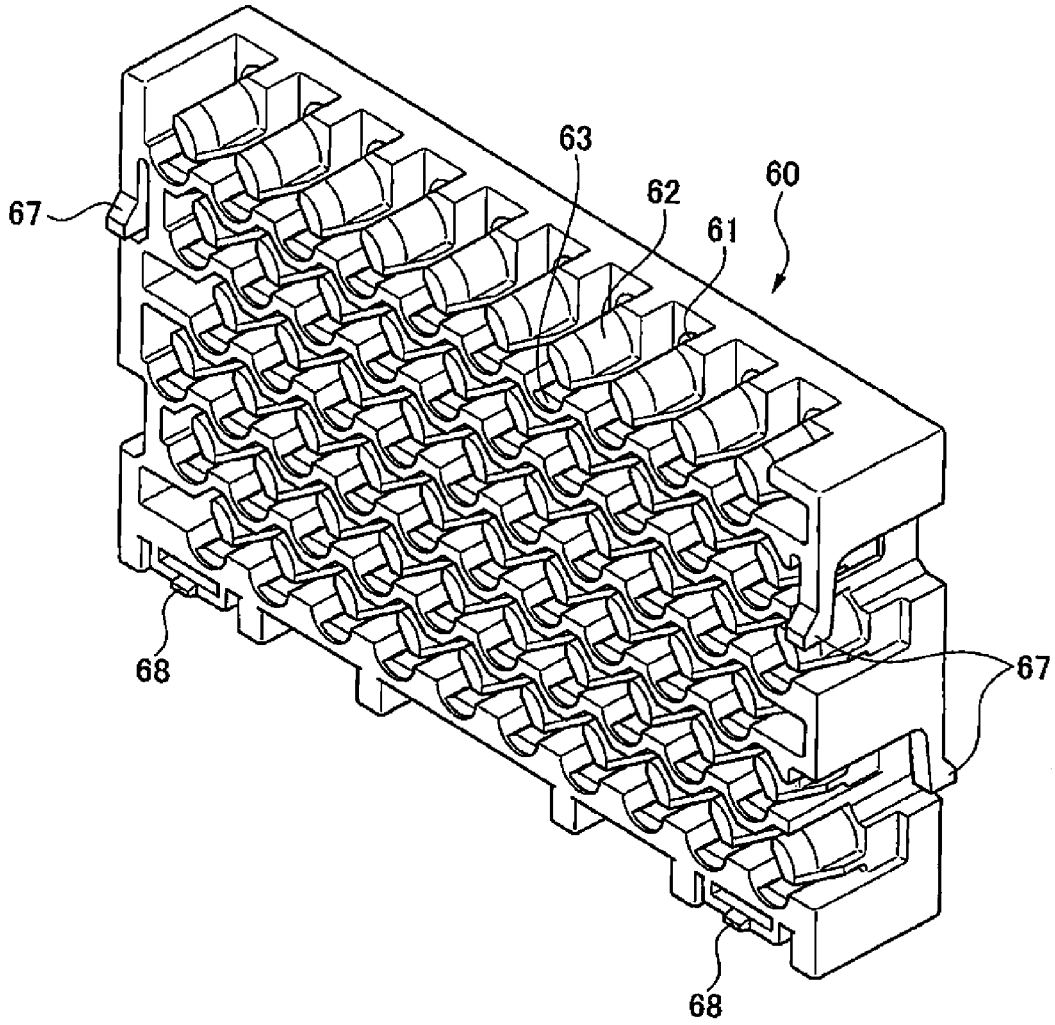
FIG. 8 is a perspective view of the spacer seen from a front surface side.
Figure 9:
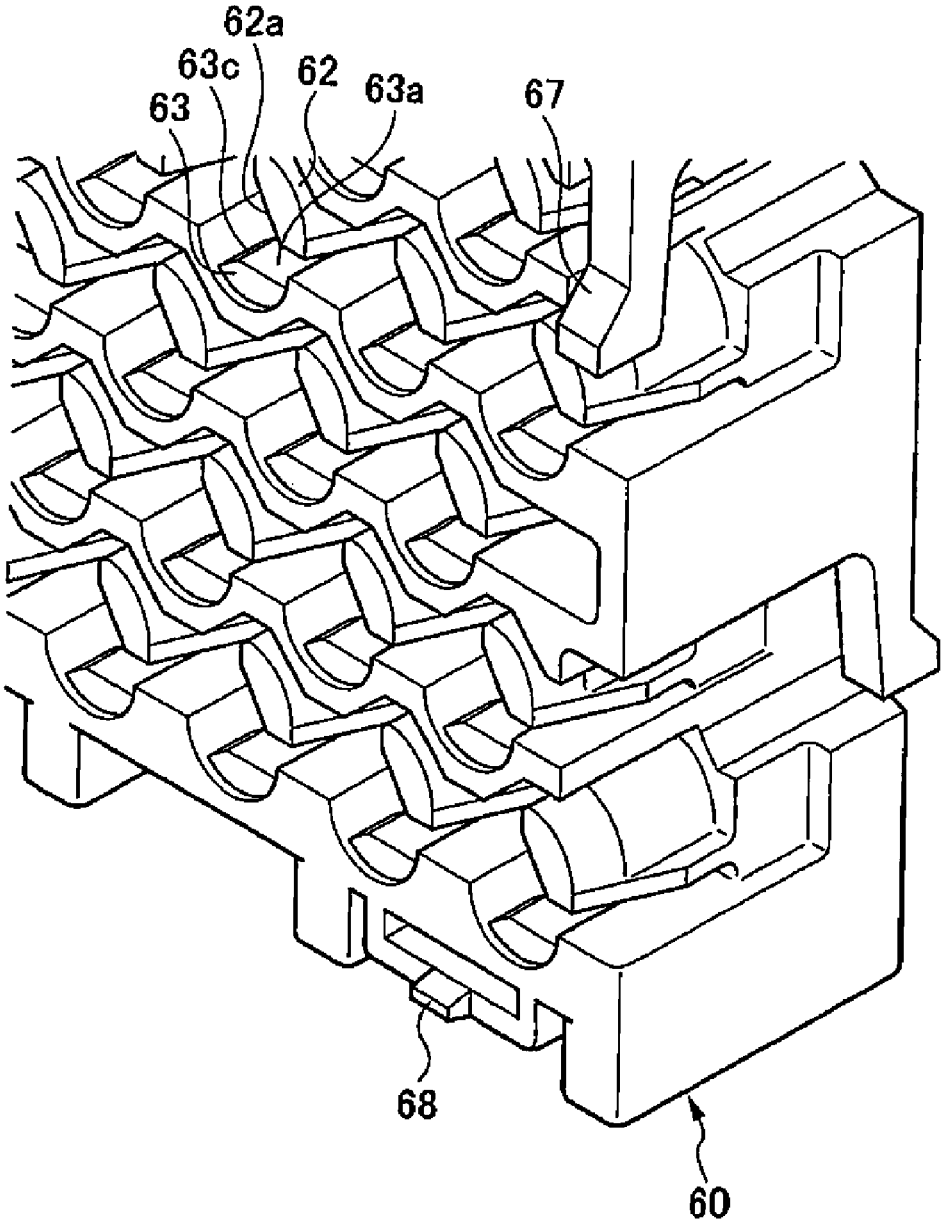
FIG. 9 is a partly enlarged view of FIG. 8.
Figure 10:
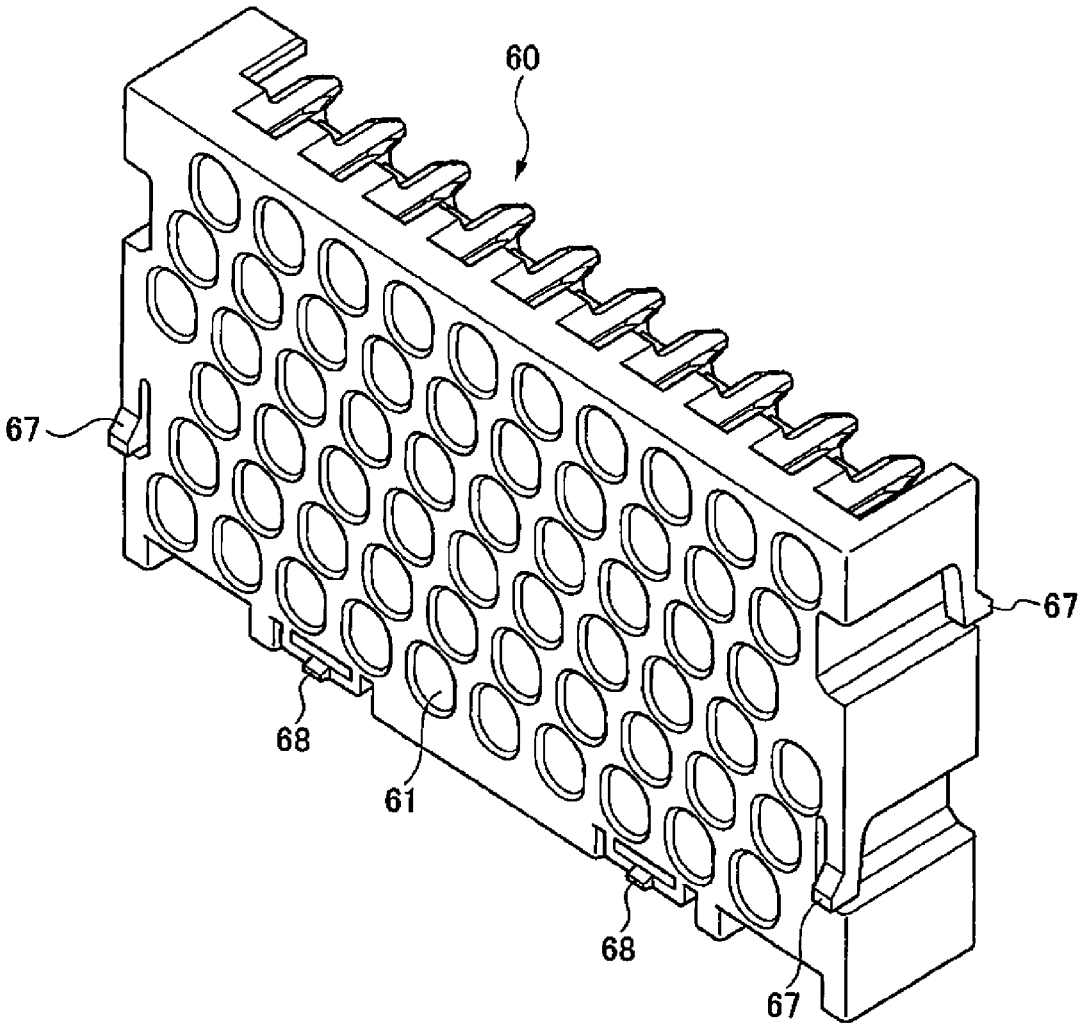
FIG. 10 is a perspective view seen from a rear surface side of the spacer.
Figure 11:
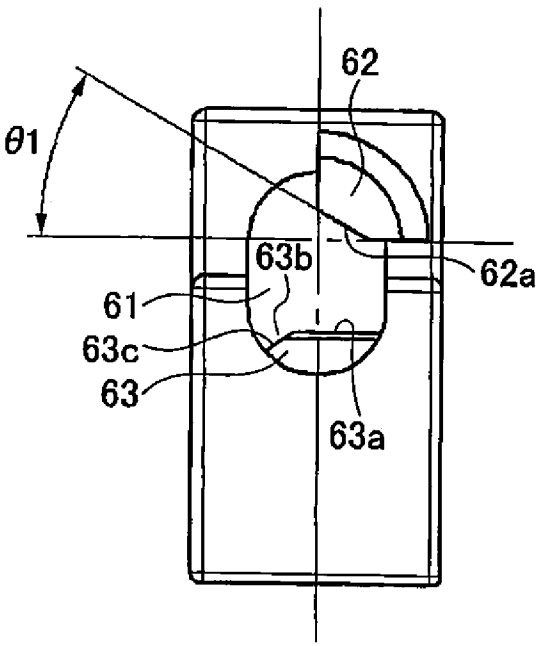
FIG. 11 is a front view of a terminal insert hole of the spacer.
Figure 11:
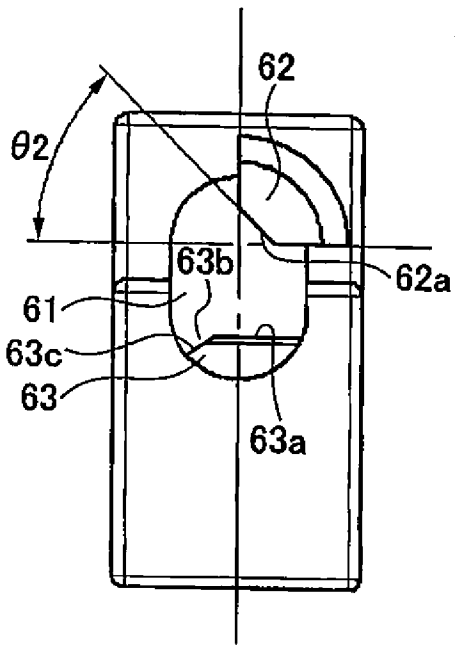
Figure 11:
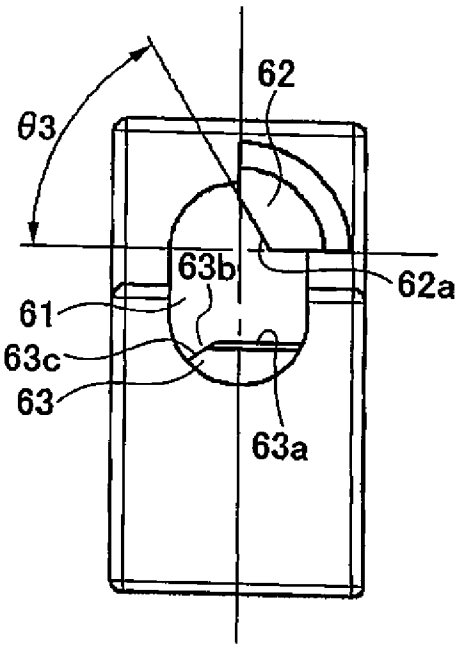

FIG. 1 is a side sectional view showing a relation between an inner housing 20, an outer housing 40 and a spacer 60 which form a connector housing 10A of a connector of an exemplary embodiment. FIG. 2 is a perspective view showing a relation between the inner housing 20 and the outer housing 40. FIG. 3 is a partly broken perspective view showing the inner housing 20 and the outer housing 40. FIG. 4 is a side sectional view showing a state that the inner housing 20 with which the spacer 60 is temporarily engaged is attached to the outer housing 40. FIG. 5 is partly broken perspective view showing the state illustrated in FIG. 4. FIG. 6 is a front view of the spacer 60. FIG. 7 is a partly enlarged view of FIG. 6. FIG. 8 is a perspective view of the spacer 60 seen from a front surface side. FIG. 9 is a partly enlarged view of FIG. 8. FIG. 10 is a perspective view seen from a rear surface side of the spacer 60. FIG. 11 is a front view of a terminal insert hole 61 of the spacer 60. FIGS. 11(*a*) to 11(*c*) show states that angles of an engaging edge part 62*a* of a lance 62 relative to an engaging edge part 63*a* of an engaging protrusion part 63 are larger in order as shown by θ1 to θ3.

Figure 12:
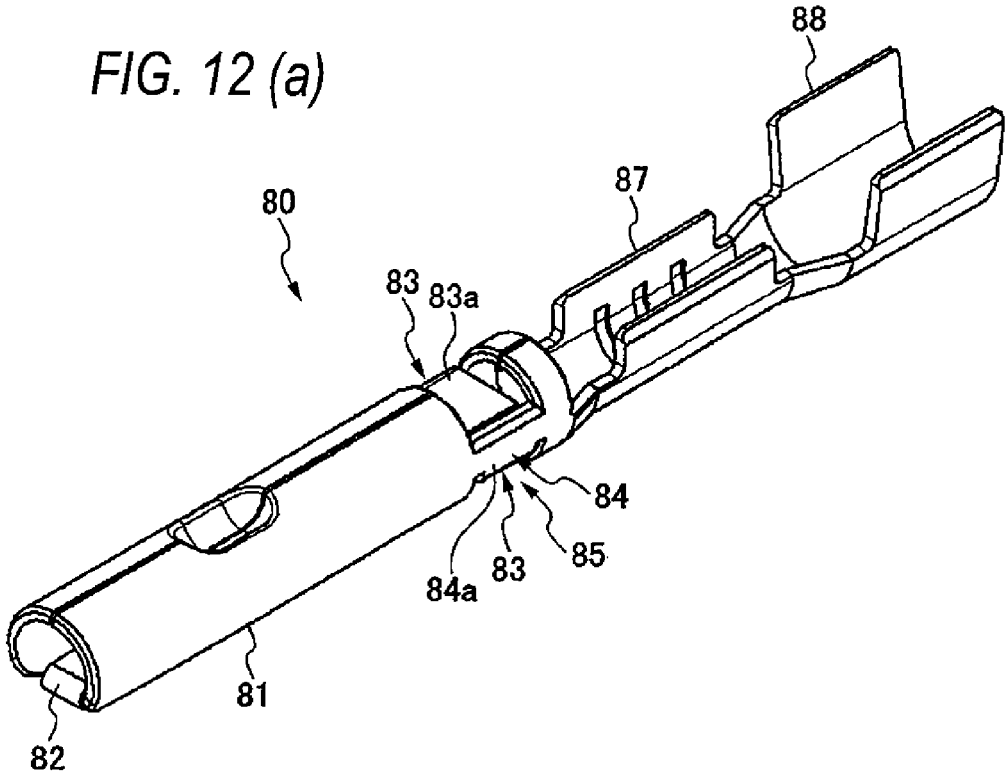
FIG. 12 is a diagram showing the structure of a female type round terminal used in the connector of the exemplary embodiment of the present invention.
Figure 12:
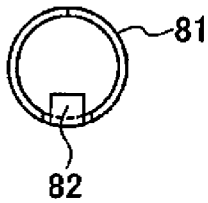
Figure 13:
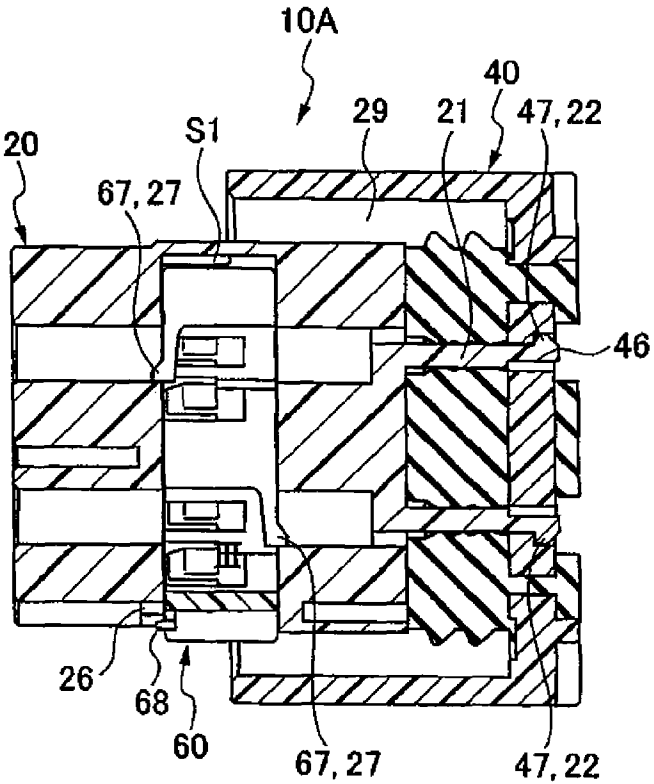
FIG. 13 is a diagram showing a state when the spacer is primarily engaged (temporarily engaged) with the inner housing in the connector housing.
Figure 13:
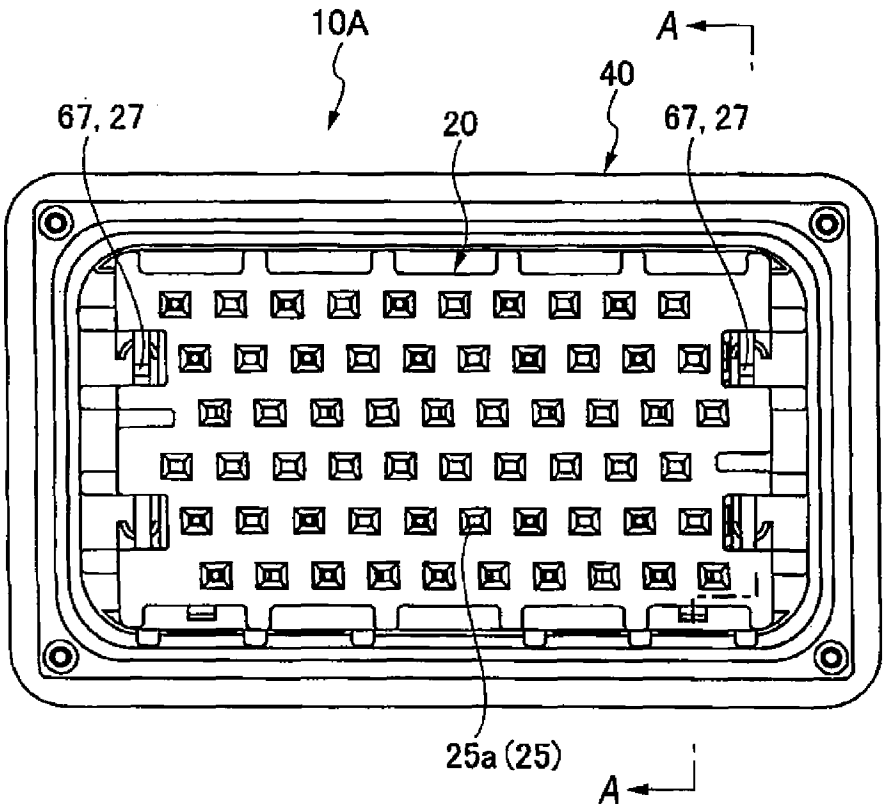
Figure 14:
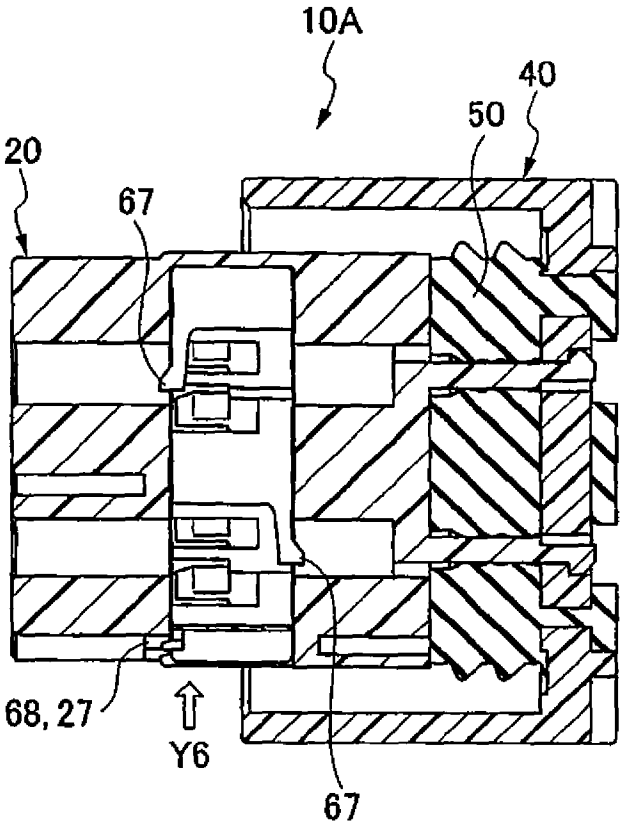
FIG. 14 is a diagram showing a state when the spacer is secondarily engaged (mainly engaged) with the inner housing in the connector housing.
Figure 14:
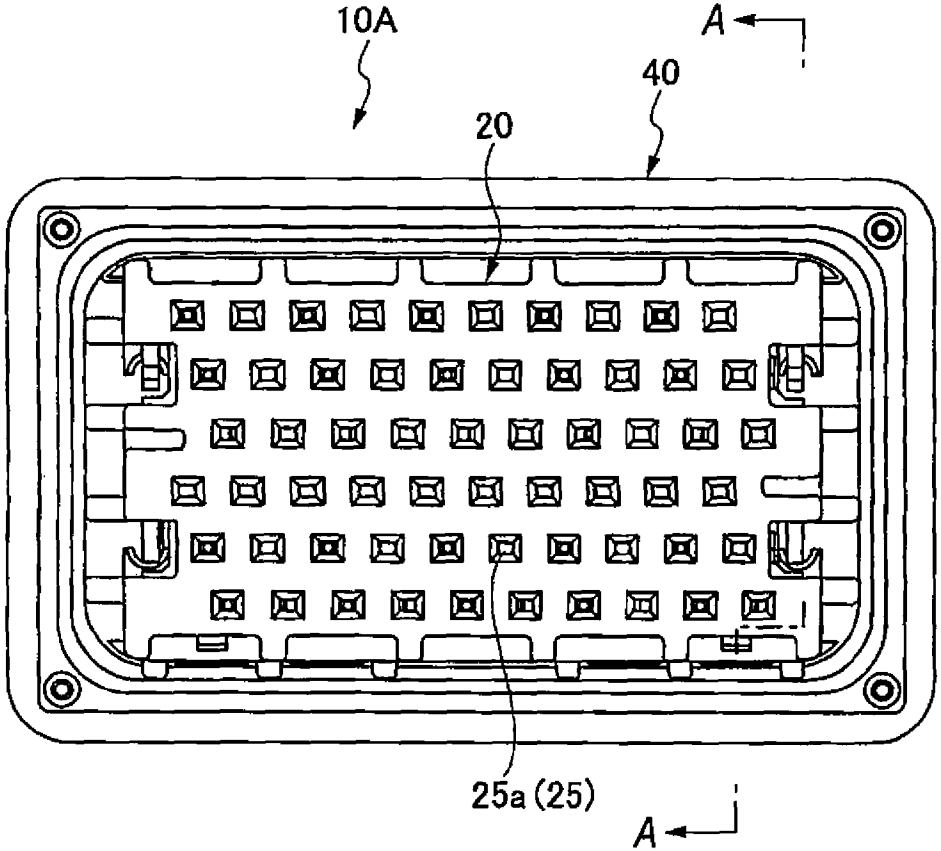
Figure 15:
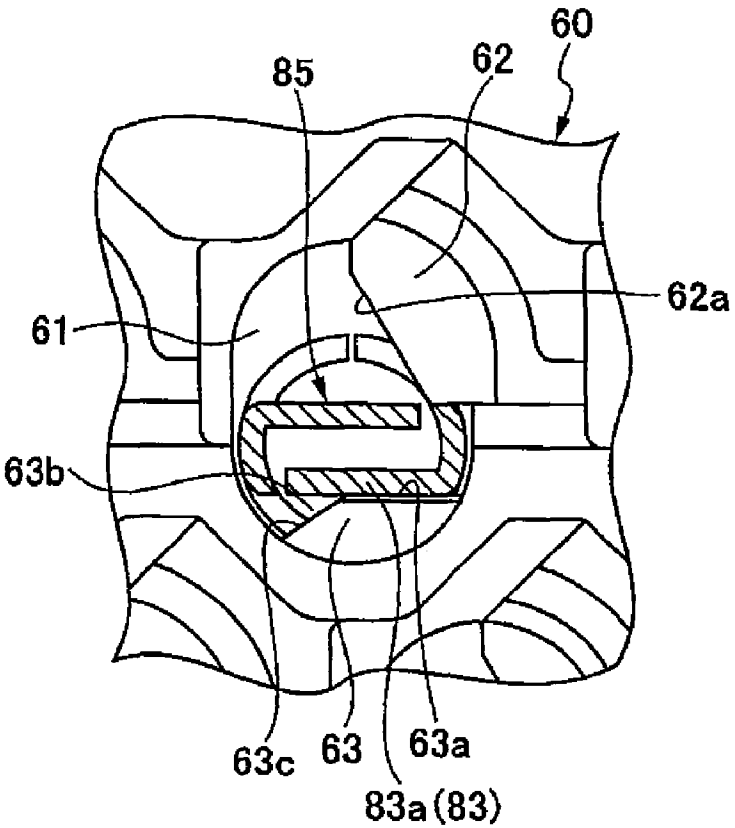
FIG. 15 is an enlarged front view showing a relation between the spacer and an engaging part of the round terminal.
Figure 15:
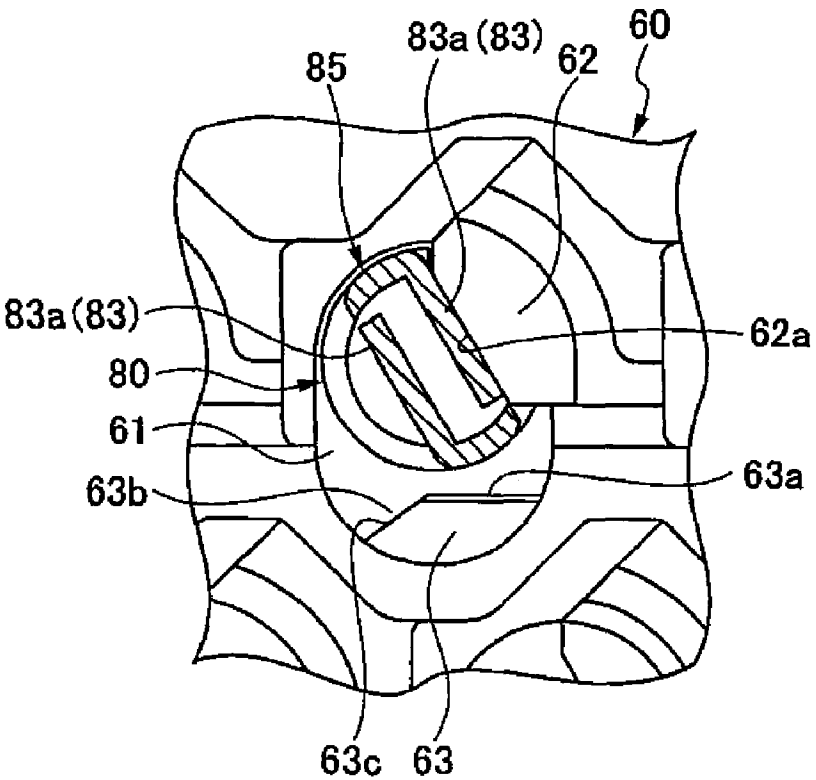
Figure 16:
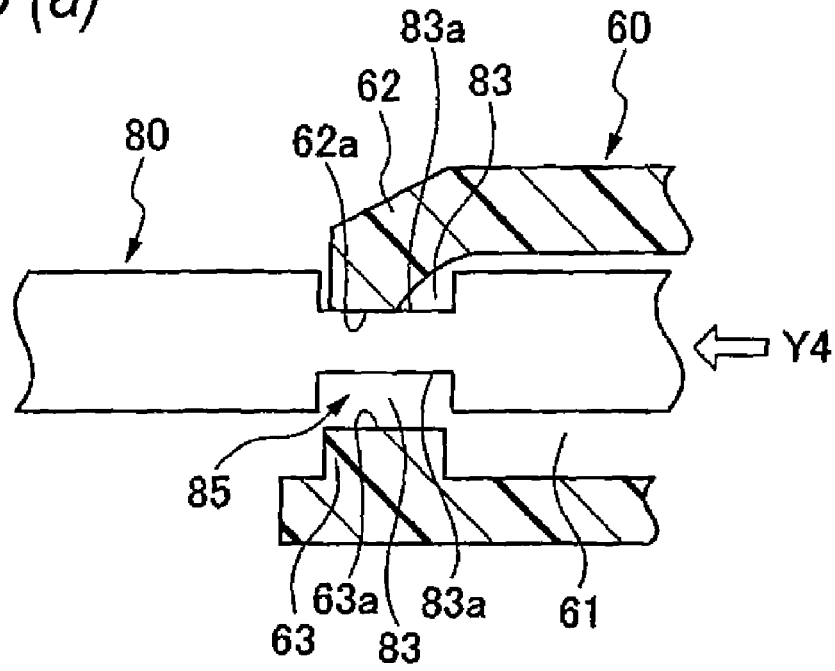
FIG. 16 is an enlarged side view showing the relation between the spacer and the engaging part of the round terminal which is illustrated for the purpose of convenience to assist one to understand FIG. 15.
Figure 16:
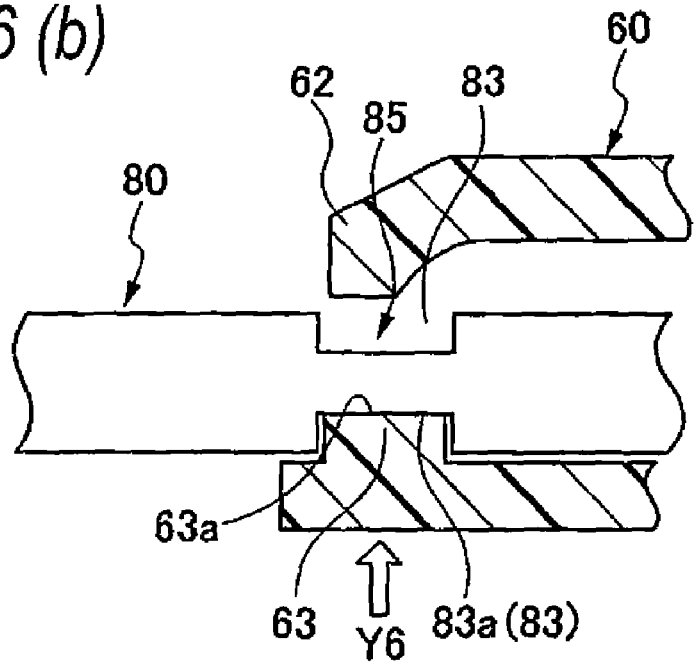
Figure 17:
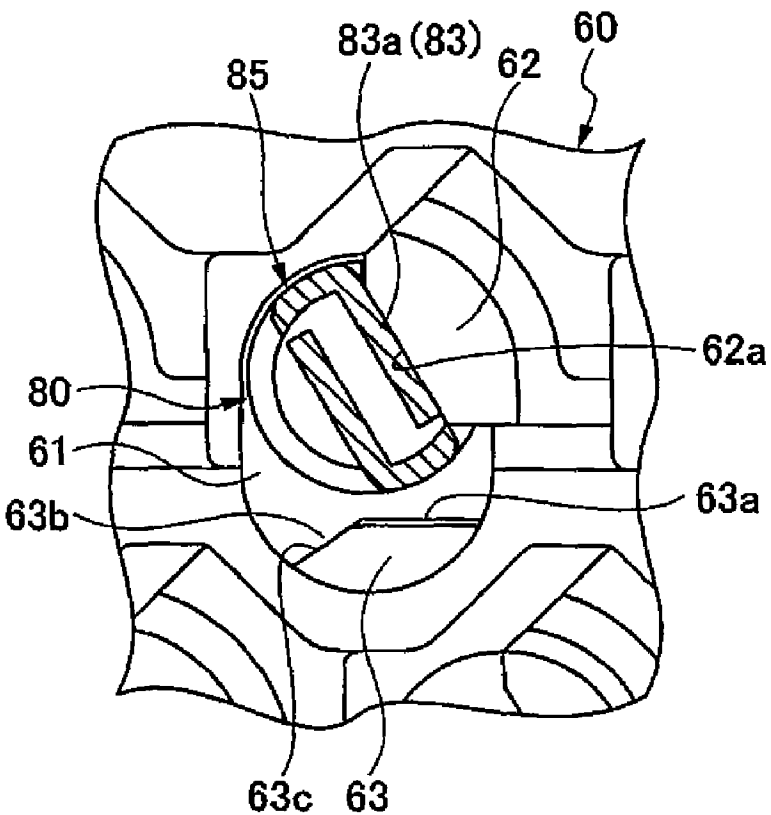
FIG. 17 is a front view showing a relation between the engaging part of the round terminal and the lance when the round terminal is inserted into the terminal insert hole of the spacer.
Figure 17:
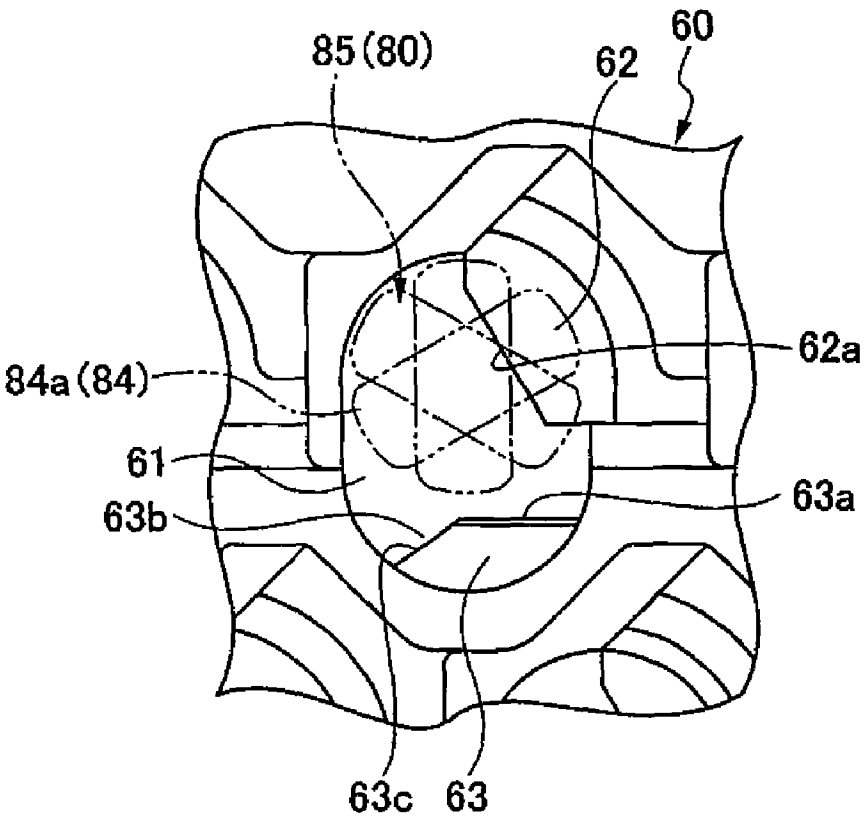
Figure 18:
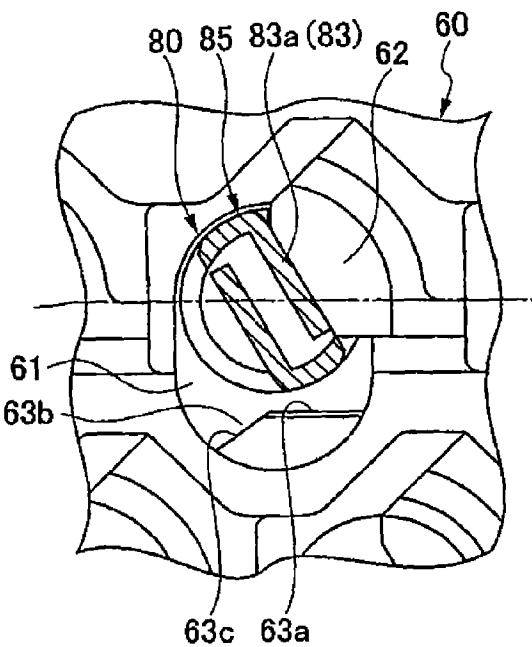
FIG. 18 is an explanatory view of contents of a position control of the round terminal when the primary engagement is shifted to the secondary engagement.
Figure 18:
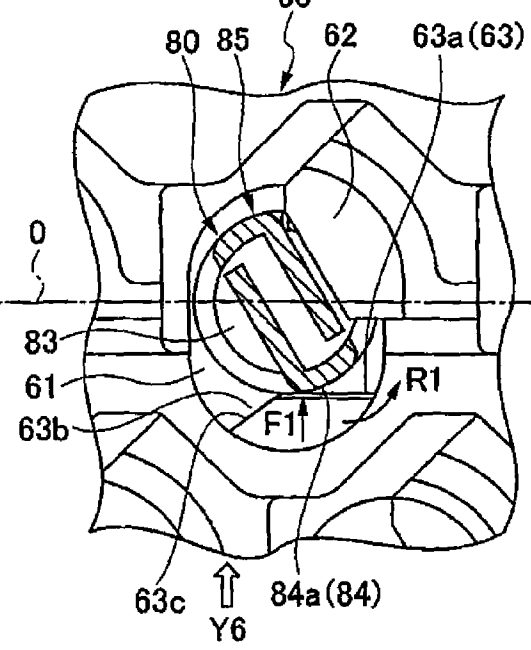
Figure 18:
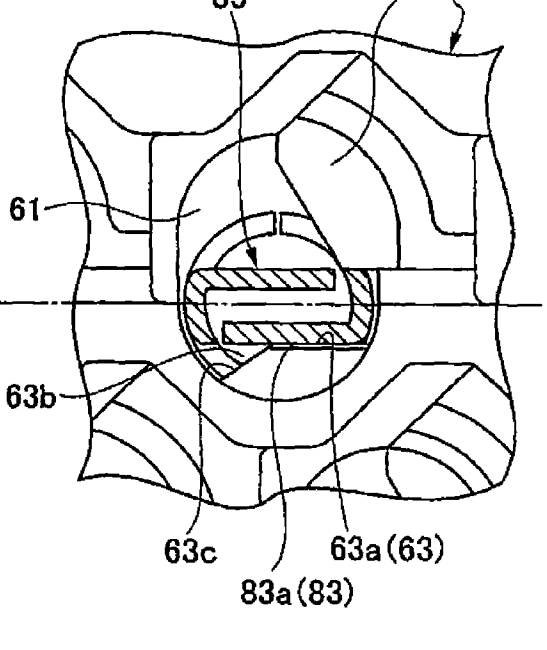

Further, FIG. 12 is a diagram showing the structure of a female type round terminal 80 used in the connector of the exemplary embodiment of the present invention. FIG. 12(*a*) is a perspective view showing an entire structure of the round terminal 80 and FIG. 12(*b*) is a front view of a cylindrical box part 81 located in a front part of the round terminal. FIG. 13 is a diagram showing a state when the spacer 60 is primarily engaged (temporarily engaged) with the inner housing 20 in the connector housing 10A. FIG. 13(*a*) is a front view and FIG. 13(*b*) is a sectional view taken along a line A-A in FIG. 13(*a*). FIG. 14 is a diagram showing a state when the spacer 60 is secondarily engaged (mainly engaged) with the inner housing 20 in the connector housing 10A. FIG. 14(*a*) is a front view and FIG. 14(*b*) is a sectional view taken along a line A-A in FIG. 14(*a*). FIG. 15 is an enlarged front view showing a relation between the spacer 60 and an engaging part 85 of the round terminal 80. FIG. 15(*a*) is a diagram showing a state that the round terminal 80 is primarily engaged (temporarily engaged) with a lance 62 of the spacer 60 and FIG. 15(*b*) is a diagram showing a state that the spacer 60 is pressed to a mainly engaged position and the round terminal 80 is secondarily engaged (mainly engaged) with the engaging protrusion part 63 of the spacer 60. FIG. 16 is an enlarged side view showing the relation between the spacer 60 and the engaging part 85 of the round terminal 80 which is illustrated for the purpose of convenience to assist one to understand FIG. 15. FIG. 16(*a*) is a diagram showing a state that the round terminal 80 is primarily engaged (temporarily engaged) with a lance 62 of the spacer 60 and FIG. 16(*b*) is a diagram showing a state that the spacer 60 is pressed to a mainly engaged position and the round terminal 80 is secondarily engaged (mainly engaged) with the engaging protrusion part 63 of the spacer 60. FIG. 17 is a front view showing a relation between the engaging part 85 of the round terminal 80 and the lance 62 when the round terminal 80 is inserted into the terminal insert hole 61 of the spacer 60. FIG. 17(*a*) is a diagram showing a relation between the round terminal and the lance 62 when the round terminal 80 is inserted in an arbitrary direction. FIG. 17(*b*) is a diagram showing a relation between the engaging part 85 of the round terminal 80 and the lance 62 during a primary engagement (a temporary engagement). FIG. 18 is an explanatory view of contents of a position control of the round terminal when the primary engagement is shifted to the secondary engagement. FIG. 18(*a*) is a front view during the primary engagement. FIG. 18(*b*) is a front view showing a state that the spacer 60 is pressed to the mainly engaged position from the temporarily engaged position so that a turning force or torque is applied to the round terminal 80. FIG. 18(*c*) is a front view during the secondary engagement.

Figure 19:
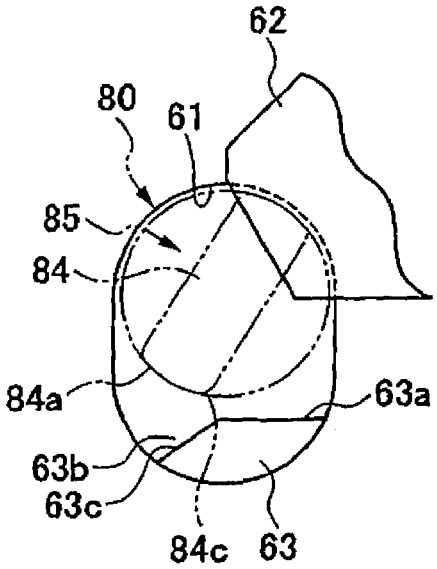
FIG. 19 is an operation explaining diagram of the exemplary embodiment of the present invention when a rotating direction position control part of the round terminal is directed to intersect the lance during the primary engagement (the temporary engagement) of the spacer.
Figure 19:
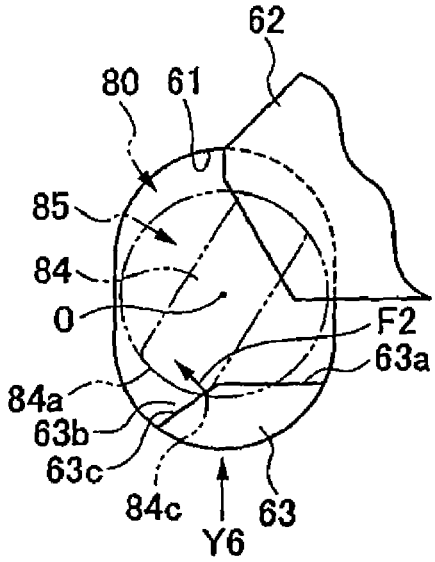
Figure 20:
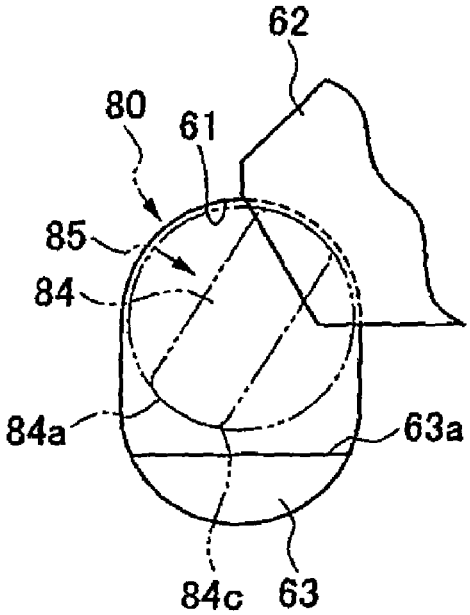
FIG. 20 is a diagram showing a comparative example to FIG. 19 and an operation explaining diagram when an inclined surface is not formed in an end part of an engaging edge part of an engaging protrusion part.
Figure 20:
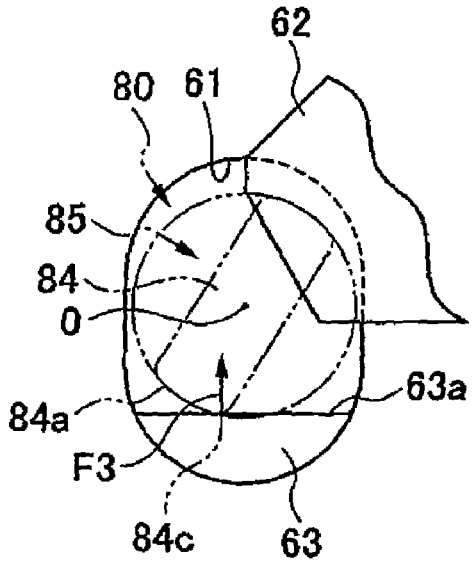

Further, FIG. 19 is an operation explaining diagram of the exemplary embodiment of the present invention when a rotating direction position control part 84 of the round terminal 80 is directed to intersect the lance 62 during the primary engagement (the temporary engagement) of the spacer 60. FIG. 19(*a*) is a front view showing a relation between the lance 62 during the primary engagement, the rotating direction position control part 84 and the engaging edge part 63*a* of the engaging protrusion part 63. FIG. 19(*b*) is a front view showing a state that an inclined surface 63*c* formed in an end part of the engaging edge part 63*a* of the engaging protrusion part 63 applies a rotation moment effective for a rotating direction position control to the round terminal 80 in accordance with an inserting operation (a movement toward a direction shown by an arrow mark Y6) of the spacer 60 from the temporarily engaged position to the mainly engaged position. FIG. 20 is a diagram showing a comparative example to FIG. 19 and an operation explaining diagram when an inclined surface 63*c* is not formed in an end part of an engaging edge part 63*a* of an engaging protrusion part 63. FIG. 20(*a*) is a front view showing a relation between a lance 62 during a primary engagement, a rotating direction position control part 84 and the engaging edge part 63*a* of the engaging protrusion part 63. FIG. 20(*b*) is a state that a rotation moment effective for a rotating direction position control cannot be applied to a round terminal 80 in accordance with an inserting operation of a pacer from a temporarily engaged position to a mainly engaged position.

Figure 21:
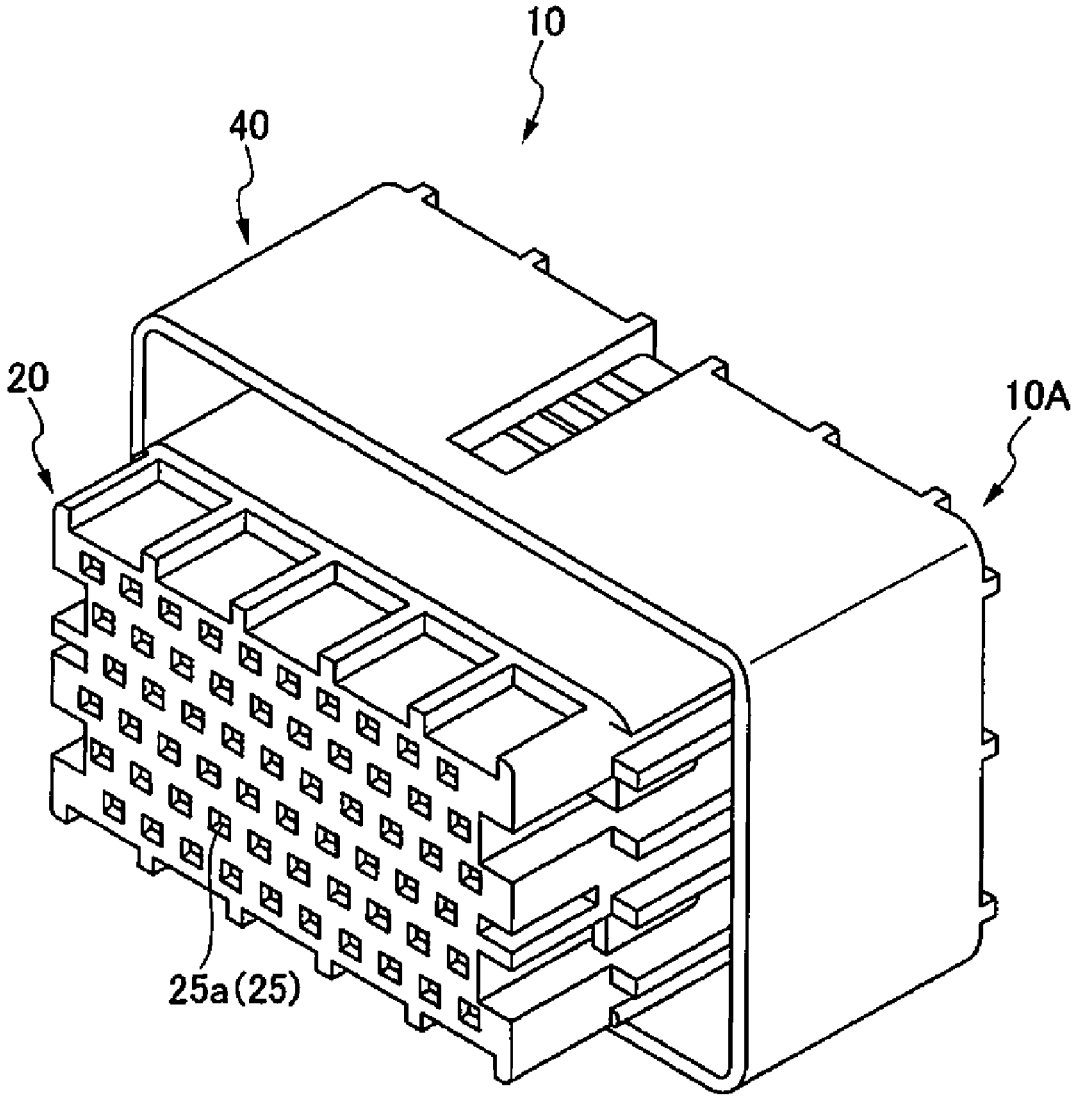
FIG. 21 is a perspective view of an external appearance of the connector of the exemplary embodiment of the present invention seen from a front side when an assembling operation is completed.
Figure 22:
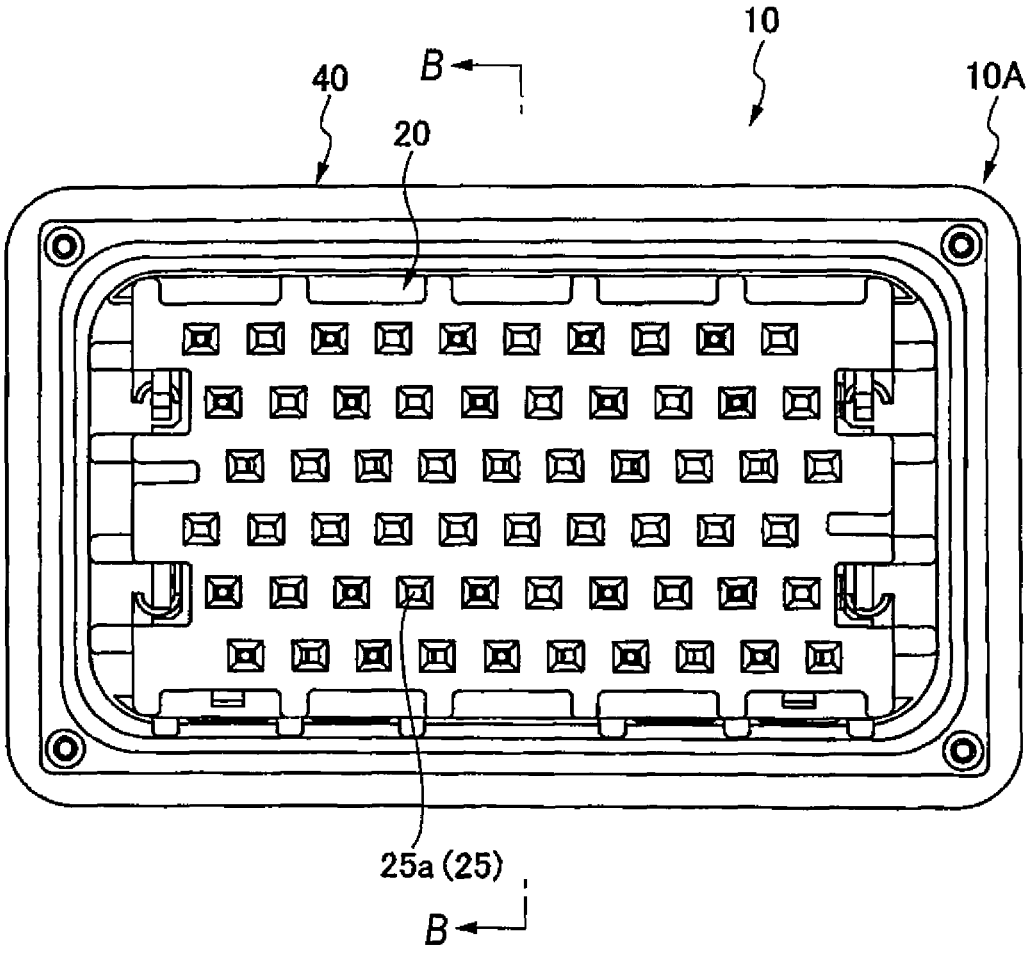
FIG. 22 is a front view of the connector seen from the front side.
Figure 23:
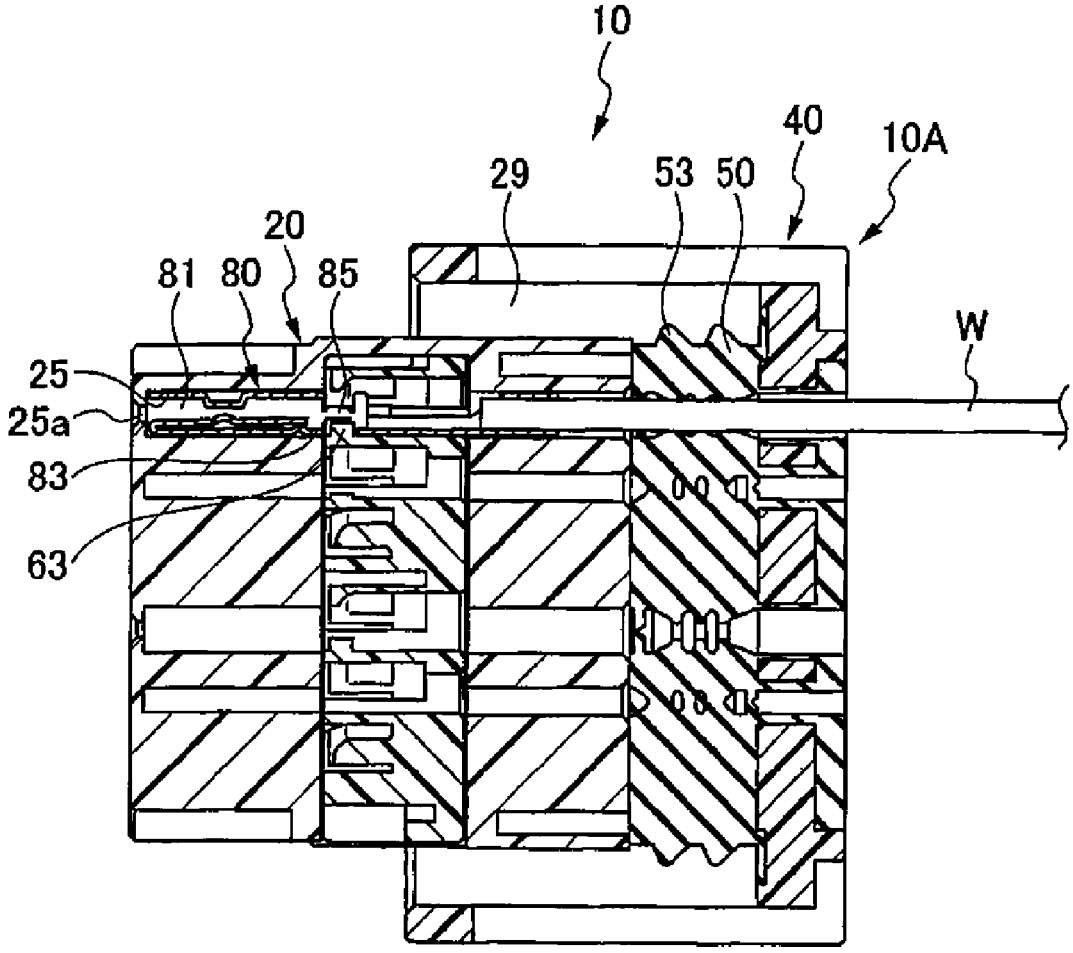
FIG. 23 is a sectional view taken along a line B-B in FIG. 22.
Figure 24:
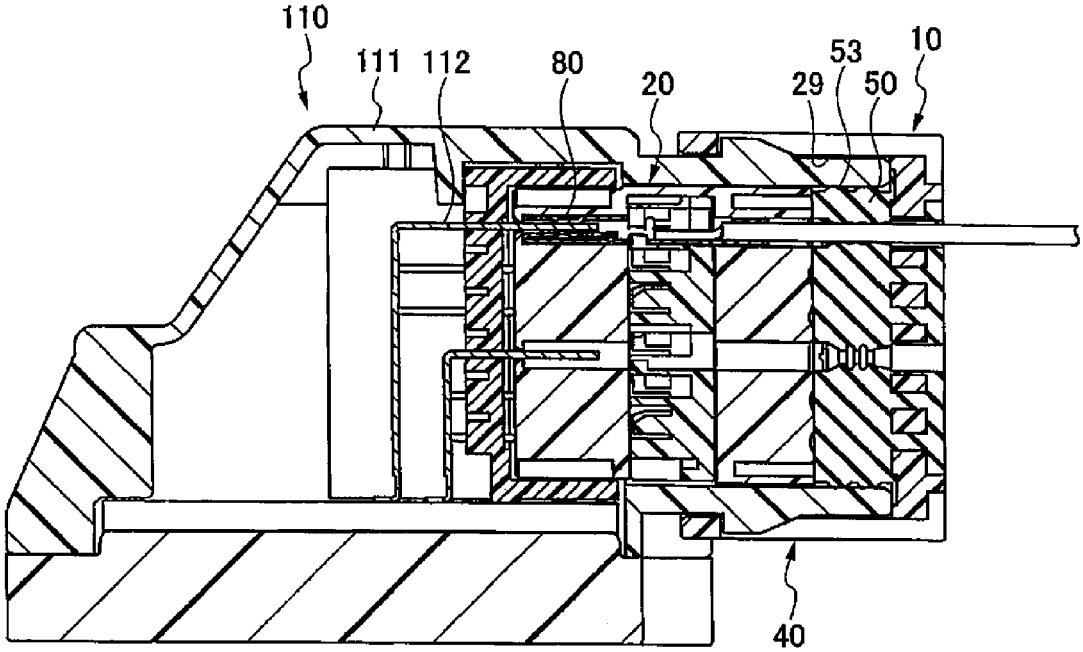
FIG. 24 is a side sectional view showing a state that the connector of the exemplary embodiment of the present invention is fitted to a mate side connector.

Further, FIG. 21 is a perspective view of an external appearance of the connector of the exemplary embodiment of the present invention seen from a front side when an assembling operation is completed. FIG. 22 is a front view of the connector seen from the front side. FIG. 23 is a sectional view taken along a line B-B in FIG. 22. FIG. 24 is a side sectional view showing a state that the connector of the exemplary embodiment of the present invention is fitted to a mate side connector.

The connector 10 includes a connector housing 10A shown in FIGS. 1 to 5 and a plurality of round terminals 80 shown in FIG. 12. The connector housing 10A is formed by combining an inner housing (corresponding to a connector housing main body) 20, an outer housing 40 and a spacer (refer it also as a retainer) 60 which are all made of a synthetic resin.

In the connector housing 10A, many terminal insert holes 25, 61 and 45 extending forward and rearward are transversely and vertically arranged and the round terminals 80 as terminals are respectively inserted into the terminal insert holes 25, 61 and 45 of the connector housing 10A from rear parts.

In the terminal insert holes 25, 61 and 45 of the connector housing 10A respectively, flexible lances (flexible engaging arms) 62 are provided to prevent the round terminals 80 from slipping out rearward when the round terminals 80 are inserted into the terminal insert holes 25, 61 and 45 from the rear parts. As described below, the lances 62 are provided in the terminal insert holes 61 of the spacer 60. As shown in FIG. 6, the lance is arranged at a position in an oblique direction relative to a vertical direction and a transverse direction seen from a central part of each terminal insert hole 61. Further, as shown in FIG. 7, a bending direction Y5 of each lance 62 is set to a direction substantially corresponding to the above-described oblique direction.

Further, in the connector housing 10A, when the arrangements of the terminal insert holes 25, 61 and 45 in the transverse direction are referred to as "lines" the terminal insert holes 25, 61 and 45 are arranged with pitches between the lines in the vertical direction set to be constant. In the lines in the vertical direction respectively, the terminal insert holes 25, 61 and 45 are linearly arranged with prescribed pitches P in the transverse direction. Further, between the lines adjacent in the vertical direction, the positions of the terminal insert holes 25, 61 and 45 are respectively shifted by 1/integer times as long as the arrangement pitch P (a pitch Pa ⅓ times as long as the pitch P in the exemplary embodiment) in the transverse direction.

Now, parts are respectively described below.

The inner housing (the connector housing main body) 20 is a rectangular block shaped member and has in rear end parts four connecting arms 21 to be connected to the outer housing 40. The connecting arms 21 respectively have engaging pawls 22 at their ends. In the inner housing 20, many terminal insert holes 25 composed of circular holes are formed. Ends of the terminal insert holes 25 are respectively opened on a front end wall of the inner housing 20 as introducing holes 25*a* (see FIG. 13) of a mate side male terminals.

Further, in the inner housing 20, a spacer insert recessed part 24 is formed from its lower surface (an outer peripheral surface) to an inner part. The spacer 60 can be inserted into the spacer insert recessed part 24 from a lower part to an upper part as shown by an arrow mark Y1 (see FIG. 1) intersecting an inserting direction Y4 (see FIG. 4) of the round terminal 80. In the spacer insert recessed part 24, as shown in FIG. 13 and FIG. 14, are provided a temporary engagement receiving part 27 with which a temporarily engaging unit 67 of the spacer 60 is engaged and a main engagement receiving part 26 with which a mainly engaging unit 68 of the spacer 60 is engaged.

A rear end outer peripheral part 28 of the inner housing 20 is set to such a dimension of an outer form as to ensure an annular space 29 for receiving a fitting tubular wall of a mate connector 110 between an inner peripheral wall 48 of a rectangular tubular periphery wall 41 of the outer housing 40 and the rear end outer peripheral part 28 when the inner housing 20 is attaché to the outer housing 40.

On the other hand, as shown in FIG. 1, in the outer housing 40, a rear end opening of the rectangular tubular periphery wall 41 having a front end opened is closed by a rear end wall 42 so that a rear half part of the inner housing 20 may be accommodated in an inner void 43. In the rear end wall 42 of the outer housing 40, the terminal inset holes 45 are formed correspondingly to the terminal insert holes 25 of the inner housing 20. Further, as shown in FIG. 3, FIG. 13 and FIG. 14, connecting holes 46 are provided into which the connecting arms 21 of the inner housing 20 are inserted. In the connecting holes 46, engaging protrusions 47 are formed with which the engaging pawls 22 of the connecting arms 21 are engaged.

Further, in a front surface (an inner surface) of the rear end wall 42 of the outer housing 40, a main body part 51 of a thick plate shaped mat seal 50 is arranged. The mat seal 50 is made of flexible rubber and is formed integrally with the outer housing 40 by a two-color molding or an insert molding.

The main body part 51 of the mat seal 50 having a seal lip 53 in an outer peripheral part is connected to a rear surface plate part 52 of a rear surface (an outer surface) of the rear end wall 42 through the terminal insert holes 45 and formed integrally therewith. In the mat seal 50, insert holes (unified by reference numerals 45) corresponding to the terminal insert holes 45 are formed. In an inner periphery of the insert hole, an inner periphery seal lip (reference numeral is omitted) that seals a part between an electric wire and the outer housing 40 is provided in close contact with an outer periphery of a coat of the electric wire W (FIG. 23) extending rearward of the round terminal 80.

Further, in the mat seal 50, as shown in FIG. 3, a seal hole 56 is provided for sealing a part between the connecting arm 21 and the outer housing 40 when the connecting arm 21 of the inner housing 20 is inserted into the connecting hole 46 of the outer housing 40.

Now, referring to FIGS. 6 to 11 and FIG. 13 and FIG. 14, the spacer 60 will be described below.

The spacer 60 is a thick plate shaped member having such a thickness as to be just inserted into the spacer insert recessed part 24 of the inner housing 20. Here, a primarily engaged (temporarily engaged) position (see FIG. 13) is set to a lower position in which an insertion of the spacer 60 is shallow relative to the spacer insert recessed part 24 and a secondarily engaged (mainly engaged) position (see FIG. 14) is set to an upper position in which the insertion is deep. Accordingly, during the primary engagement shown in FIG. 13, a space S1 where the spacer 60 can be more pushed is ensured in an interior of the spacer insert recessed part 24.

In the spacer 60, as shown in FIG. 13 and FIG. 14, are provided the temporarily engaging unit 67 that is engaged with the temporary engagement receiving part 27 of the inner housing 20 side to temporarily engage the spacer 60 in the temporarily engaged position and the mainly engaging unit 68 that is engaged with the main engagement receiving part 26 of the inner housing 20 side to mainly engage the spacer 60 in the mainly engaged position.

Further, the spacer 60 has many terminal insert holes 61 corresponding to the terminal insert holes 25 and 45 of the inner housing 20 or the outer housing 40. The terminal insert holes 61 are arranged as described above. In this case, the terminal insert holes 61 of the spacer 60 are formed in elliptical shapes long in the vertical direction.

In each of the terminal insert holes 61, the lance 62 as a temporarily terminal engaging unit is provided. The lance 62 is located in an obliquely upper position relative to the vertical direction and transverse direction seen from the central part of each terminal insert hole 61. In this exemplary embodiment, the lance 62 is arranged at the obliquely upper position of a right part seen from a front surface of the connector. The bending direction Y5 (FIG. 7) is set to the direction substantially corresponding to the oblique direction.

When the spacer 60 is located in the temporarily engaged position, the lance 62 is bent outward so as to permit the found terminal 80 to be inserted into the terminal insert hole 61. When the round terminal 80 is inserted to a prescribed position, the lance is returned from its bent state to engage an engaging edge part 62*a* provided as an edge part orthogonal to the bending direction with an engaging recessed part 83 of the round terminal 80 so that the round terminal 80 may be prevented (temporarily engaged) from slipping out rearward.

Further, in an inner bottom part of the terminal inset hole 61 of the spacer 60, an engaging protrusion part 63 is provided as a mainly terminal engaging unit that allows an engaging edge part 63*a* to be engaged with the engaging recessed part 83 of the round terminal 80 and assuredly prevents (mainly engages) the round terminal 80 from moving forward and backward when the spacer 60 is pressed to a mainly engaged position from a temporarily engaged position. The engaging edge part 63*a* of the engaging protrusion part 63 is provided as an edge part substantially parallel to the transverse direction. Thus, between the engaging edge part 63*a* of the engaging protrusion part 63 and the engaging edge part 62*a* of the lance 62, an angle θ (FIG. 7) larger than 0° and smaller than 90° is ensured.

Accordingly, the engaging protrusion part 63 as the mainly terminal engaging unit is arranged in a position of a front side of an inserting direction when the spacer 60 is inserted into the spacer insert recessed part 24 in an inner periphery of the terminal insert hole 61 of the spacer 60. The engaging edge part 63*a* of the engaging protrusion part 63 is provided as an edge part substantially parallel to a direction orthogonal to the inserting direction of the spacer 60.

Further, the lance 62 is arranged at the obliquely right and upper position shifted from a front position opposed to the engaging protrusion part 63 in the inner periphery of the terminal insert hole 61 of the spacer 60. The engaging edge part 62*a* of the lance 62 fitted to the engaging recessed part 83 of the round terminal 80 is provided as the edge part orthogonal to the bending direction (the direction shown by the arrow mark Y5) of the lance 62.

In this case, in a left end part (an opposite side to a side in which the lance 62 is provided) of the engaging edge part 63*a* of the engaging protrusion part 63 of the spacer 60, an oblique cut-out part 63*b* is provided to form an inclined surface 63*c* that inclines a direction of force when a contact pressure is applied to a rotating direction position control part 84 relative to the inserting direction (a direction shown by an arrow mark Y6) of the spacer 60.

An angle of the inclined surface 63*c* relative to the engaging edge part 63*a* may be preferably set within a range of 30° to 60°. Further, since the engaging edge part 63*a* needs to abut on a below-described inner bottom surface (a positioning surface 83*a*) of the engaging recessed part 83 of the round terminal 80 to assuredly determine a position of the round terminal 80 in the rotating direction, a prescribed length (a length necessary for positioning the round terminal in the rotating direction) needs to be ensured in a central part of the transverse direction at the minimum.

Further, as shown in FIG. 12, the round terminal 80 includes a cylindrical box part (an electric connecting part) 81 that receives a male terminal 112 of a mate connector 110. In the box part 81, a spring piece 82 is provided. In a rear side of the box part 81 of the round terminal 80, an engaging part 85 is provided that is engaged with the lance 62 and the engaging protrusion part 63 and positions the round terminal 80 in the rotating direction during the engaging process. In a further rear side of the engaging part 85, an electric wire connecting part (an electric conductor, caulking part 87 and a coat caulking part 88) to which a terminal of a coated electric wire W is connected.

The engaging part 85 includes the engaging recessed part 83 formed by recessing two opposed surfaces of a cylindrical periphery wall forming the box part 81 by the same dimension and the rotating direction position control part 84 with a substantially rectangular shape in section which has, as short sides, a cylindrical periphery wall remaining at a position where the engaging recessed part 83 is formed and, as long sides, the inner bottom surface of the engaging recessed part 83.

The engaging recessed part 83 is provided for allowing the engaging edge part 62*a* of the lance 62 and the engaging edge part 63*a* of the engaging protrusion part 63 of the spacer 60 to be fitted to the engaging recessed part so that the round terminal 80 is prevented from moving forward and backward. The inner bottom surface of the engaging recessed part 83 serves as the positioning surface 83*a*.

Further, the rotating direction position control part 84 is provided for applying a rotation for controlling a position in the rotating direction to the round terminal 80 by a rotation moment generated by a contact pressure when the engaging edge part 62*a* of the lance 62 and the engaging edge part 63*a* of the engaging protrusion part 63 of the spacer 60 are pressed to come into contact with the engaging recessed part. A short side part formed by an outer peripheral surface of the cylindrical periphery wall of the box part 81 serves as an abutting surface 84*a*.

In this case, the engaging part 85 has a substantially rectangular shape in section and to which direction the rotation moment is applied is determined in accordance with a positional relation between an abutting position when the engaging edge part 63*a* of the engaging protrusion part 63 abuts on a corner part of the engaging part and a center of a section of the round terminal 80. At that time, when the lance 62 is properly temporarily engaged with the round terminal 80, it is decided whether or not an effective rotation moment is assuredly generated by a dimension of the short side of the rotating direction position control part 84 having the substantially rectangular shape in section, a radius from the center ○ of the section of the round terminal 80 to the abutting surface 84*a* and an angle θ formed by the engaging edge part 62*a* of the lance 62 and the engaging edge part 63*a* of the engaging protrusion part 63.

Thus, in order to assuredly apply the rotation moment, the angle θ formed by the engaging edge part 63*a* of the engaging protrusion part 63 and the engaging edge part 62*a* of the lance 62 is set to a range of 30° to 60° as shown in FIG. 11. FIG. 11(*a*) shows a case that θ is θ1 (30°), FIG. 11(*b*) shows a case that θ is θ2 (45°) and FIG. 11(*c*) shows a case that θ is θ3 (60°). In all the cases, the rotation moment can be assuredly applied.

Now, a procedure of an assembling operation will be described below.

When the connector 10 is assembled, as shown by the arrow mark Y1 in FIG. 1, initially, the spacer 60 is inserted into the spacer insert recessed part 24 of the inner housing 20 from a lower part to primarily engage (temporarily engage) the spacer 60 with the inner housing 20 (a state shown in FIG. 13).

Then, the inner housing 20 is attached to the outer housing 40 as shown by an arrow mark Y2 in FIG. 1 and an arrow mark Y3 in FIG. 4 to connect the outer housing 40 to the inner housing 20 by the connecting arms 21.

Then, under this state, since the connector housing 10A in a temporarily engaged state is formed, the round terminal 80 is inserted from a rear part of the outer housing 40 as shown by an arrow mark Y4 in FIG. 4.

When the round terminal 80 is inserted until the engaging part 85 of the round terminal 80 reaches the lance 62, as shown in FIG. 15 and FIG. 16, the round terminal 80 is primarily engaged with the lance 62. At this time, as shown in FIG. 17(*a*), even when the round terminal 80 is inserted in any orientation, the rotation moment for correcting the position is applied to the round terminal 80 due to a pressure contact between the abutting surface 84*a* of the rotating direction position control part 84 of the engaging part 85 and the engaging edge part 62*a* of the lance 62. Thus, as shown in FIG. 17(*b*), the engaging recessed part 83 faces the lance 62 in a proper position, the positioning surface 83*a* of the engaging recessed part 83 is parallel to the engaging edge part 62*a* of the lance 62 in a stable state and the engaging edge part 62*a* of the lance 62 is fitted to the engaging recessed part 83 so that the round terminal 80 is primarily engaged (temporarily engaged).

When all the round terminals 80 are inserted, the spacer 60 is more pushed in upward to secondarily engage (mainly engage) the spacer 60 with the inner housing 20 (a state shown in FIG. 14). Thus, during a process of raising the spacer 60, as shown in FIG. 18(*b*), the lance 62 is separated from the engaging part 85 of the round terminal 80 and the engaging edge part 63*a* of the engaging protrusion part 63 is pressed to come into contact with the corner part of the abutting surface 84*a* of the rotating direction position control part 84 of the round terminal 80. Thus, the rotation moment is generated by the contact pressure F1 and the abutting position.

Thus, the round terminal 80 is rotated in a direction shown by an arrow mark R1, and finally, the engaging edge part 63*a* of the engaging protrusion part 63 is more raised so that the engaging edge part 63*a* of the engaging protrusion part 63 abuts on the positioning surface 83*a* as the bottom surface of the engaging recessed part 83 as shown in FIG. 18(*c*) to determine the position of the round terminal 80 in the rotating direction. Further, since the engaging edge part 63*a* of the engaging protrusion part 63 is fitted to the engaging recessed part 83, the round terminal 80 is secondarily engaged (mainly engaged). At this time, the spacer 60 is mainly engaged with the inner housing 20. Thus, the assembly of the connector 10 as shown in FIGS. 21 to 23 is completed.

Namely, under a state that the spacer 60 is inserted into the spacer insert recessed part 24 of the inner housing (the connector housing main body) 20 and temporarily engaged therewith, the round terminal 80 is inserted into the terminal insert hole 25 from the rear part. Under this state, when the spacer 60 is inserted into the mainly engaged position, the round terminal 80 can be assuredly prevented from slipping out by the engagement of the engaging protrusion part 63 provided in the spacer 60 with the engaging recessed part 83 of the round terminal 80.

At that time, by an operation for inserting the spacer 60 into the mainly engaged position from the temporarily engaged position, the rotating direction position control part 84 of the round terminal 80 whose orientation is not proper can be pressed by the engaging edge part 63*a* of the engaging protrusion part 63 of the spacer 60. The rotation moment necessary for controlling the position of the rotating direction can be applied to the round terminal 80 by the contact pressure F1 due to the pressure contact. Accordingly, only when the spacer 60 is inserted into the mainly engaged position, the orientation of all the round terminals 80 can be unified.

As shown in FIG. 20, occasionally, the engaging recessed part 83 of the round terminal 80 may not be properly engaged with the engaging edge part 62*a* of the lance 62 so that the rotating direction position control part 84 having the substantially rectangular shape in section is stopped in a direction intersecting the engaging edge part 62*a* of the lance 62. When such a case arises, the engaging part 85 of the round terminal 80 may be possibly sandwiched between a bending resistance (an elastic reaction force) of the lance 62 and an inserting force of the spacer 60 so that the effective rotation moment is not applied to the rotating direction position control part 84.

For instance, as in a comparative example shown in FIGS. 20(*a*) and 20(*b*), when an engaging edge part 63*a* of an engaging protrusion part 63 of a spacer 60 is provided as an edge part whose entire width in the transverse direction is vertical to an inserting direction of the spacer 60, a contact pressure F3 applied to a rotating direction position control part 84 from the engaging edge part 63*a* is exerted in a direction parallel to the inserting direction of the spacer 60. Accordingly, depending on the orientation of the rotating direction position control part 84, a large rotation moment may not be possibly generated owing to a relation between a direction to which the contact pressure F3 is applied and a center ○ of rotation of a round terminal (a center of a section of an electric connecting part of the terminal) 80. In such a case, the inserting force of the spacer 60 needs to be more increased to increase the rotation moment. Especially, when there are many round terminals 80, the spacer 60 is supposed to be hardly attached.

However, in the connector of the present exemplary embodiment, as shown in FIGS. 19(*a*) and 19(*b*), the inclined surface 63*c* is provided in the end part of the engaging edge part 63*a* of the engaging protrusion part 63 and a direction of a force F2 when the contact pressure is applied to the rotating direction position control part 84 of the round terminal 80 is inclined relative to the inserting direction of the spacer 60. Accordingly, a direction to which the contact pressure is applied can be directed to a direction effective for generating the rotation moment. Thus, even a small spacer inserting force can give a large turning force or torque for correcting the position in the rotating direction to the round terminal 80 and can easily and uniformly correct the direction of the round terminal 80 so as to have a uniform orientation. Therefore, an attaching performance can be improved.

After the connector 10 is assembled, as shown in FIG. 24, when the connector 10 is fitted to the mate connector 110, an end of a fitting wall part of a mate connector housing 111 enters the annular space 29 between the inner housing 20 and the outer housing 40 of the connector 10 of the exemplary embodiment and the fitting wall part comes into close contact with the seal lip 53 of the mat seal 50 to seal a fitting part of the inner housing 20 and the mate connector housing 111. Further, the male terminal 112 of the mate connector 110 is introduced into the box part 81 of the round terminal 80 held in the inner housing 20 from an insert hole of the front end of the inner housing 20 to connect both the connectors to each other.

In addition to the above-described explanation, according to the connector 10 of the present exemplary embodiment, since the spacer 60 that engages the inserted round terminal 80 is provided integrally with the lances 62 as the temporarily terminal engaging units, under a state that the individual round terminals 80 are respectively temporarily engaged with the lances 62, the spacer 60 is inserted to the mainly engaged position, so that all the round terminals 80 can be mainly engaged with the mainly terminal engaging parts (the engaging protrusion parts 63) provided in the spacer at the same time. Accordingly, assembly workability is improved and the terminals can be assuredly fixed.

Further, according to the connector 10 of the present exemplary embodiment, since the engaging edge part 63*a* of the engaging protrusion part 63 and the engaging edge part 62*a* of the lance 62 of the spacer 60 are fitted to the engaging recessed part 83 of the round terminal 80 and further, the engaging edge part 63*a* of the engaging protrusion part 63 and the engaging edge part 62*a* of the lance 62 of the spacer 60 are pressed to come into contact with the rotating direction position control part 84 of the round terminal 80, the position in the rotating direction of the round terminal 80 which is inserted without caring about the orientation during the temporary engagement of the lance 62 can be corrected to a position suitable for the lance 62. As described above, when the spacer 60 is pushed in to the mainly engaged position during a shift from the temporarily engaged state to the mainly engaged state, the round terminal 80 can be corrected to a proper engaged position by a pushing operation of the spacer 60. Thus, even when the round terminal 80 is used, the terminal can be automatically positioned to a proper position and assembled in a final assembly stage.

Further, according to the connector 10 of the present exemplary embodiment, many terminal insert holes 25, 45 and 61 of the connector housing 10A are arranged in the vertical direction and the transverse direction of the connector housing 10A. The spacer insert recessed part 24 of the inner housing 20 as the connector housing main body is formed in such a direction as to insert the spacer 60 upward from the lower surface of the inner housing 20. In each of the terminal insert holes 61 of the spacer 60, since the engaging protrusion part 63 is arranged in a lower position of an inner periphery of the terminal insert hole 61 and the lance 62 is arranged in the obliquely upper position, blank spaces between the plurality of terminal insert holes 61 are effectively used and the lances 62 can be arranged or the bending spaces of the lances 62 can be ensured. Accordingly, the terminal insert holes 61, namely, the round terminals 80 can be densely arranged, which can contribute to the miniaturization or the multi-polar form of the connector 10.

Further, according to the connector 10 of the present exemplary embodiment, since the positions of the terminal insert holes 25, 45 and 61 in the transverse direction are shifted between adjacent upper and lower lines, the blank spaces between the terminal insert holes 25, 45 and 61 are effectively used and many terminal insert holes 25, 45 and 61 can be densely arranged in the vertical direction. Accordingly, the round terminals 80 can be more densely arranged, so that the connector can be more miniaturized or the connector can obtain a more multi-polar form.

Further, since an amount of shift Pa of the terminal insert holes 25, 45 and 61 in the transverse direction between the adjacent upper and lower lines is set to ⅓ times as long as the pitch P between the terminals in the transverse direction, the positions of the terminal insert holes 25, 45 and 61 can be allowed to mutually correspond in the transverse direction at intervals of two lines in the vertical direction. Accordingly, a prescribed regularity can be provided irrespective of a zigzag arrangement. Especially, when the terminal insert holes 61 are arranged by shifting them by ⅓ times as long as the pitch between the adjacent lines, since the lances 62 can be reasonably arranged in the blank spaces between the terminal insert holes 61 in the upper line, the pitches between the terminal insert holes 61 can be reduced and the round terminals 80 can be densely arranged, which can greatly contribute to the miniaturization and the multi-polar form of the connector.

In the above described exemplary embodiment, the pitches between the terminals are shifted by ⅓ times as long as the pitch between the upper and lower lines, however, the pitches may be shifted by ½ times as long as the pitch. In any case, the pitches may be shifted by 1/integer times as long as the pitch. Further, the present invention may be applied even to a case that the terminal insert holes 61 arranged in the vertical direction are not shifted in the transverse direction between the lines and the terminal insert holes 61 are also linearly arranged in the transverse direction and vertical direction.

Further, in the above-described exemplary embodiment, many terminal insert holes 25, 45 and 61 are arranged in the vertical direction and the transverse direction of the connector housing 10A, however, the present invention may be applied to a connector having a single terminal or a connector having a smaller number of terminals.

Further, in the present exemplary embodiment, the inclined surface 63*c* is provided in the end part (the opposite side to the side having the lance 62) of the left side of the engaging edge part 63*a* of the engaging protrusion part 63 in FIG. 6. However, the inclined surface 63*c* may be provided in the end part (the side having the lance 62) in the right side in FIG. 6. In that case, the rotation moment can be more effectively generated under a state shown in FIG. 18(*b*). Accordingly, the position of the round terminal 80 can be more easily changed. Further, inclined surfaces may be provided at both ends in the transverse direction of the engaging edge part 63*a* to ensure the engaging edge part 63*a* orthogonal to a spacer inserting direction between the right and left inclines surfaces.

What is claimed is:

1. A connector including:

a connector housing having terminal insert holes extending forward and backward; and terminals respectively inserted into the terminal insert holes of the connector housing from a rear part, a flexible lance being provided in each of the terminal insert holes of the connector housing to prevent the terminal slipping out rearward when the terminal is inserted into each terminal insert hole from the rear part, wherein the connector housing includes a connector housing main body having the terminal insert holes composed of circular holes and a spacer insert recessed part formed from an outer peripheral surface to an inner part and a spacer that can be inserted into the spacer insert recessed part of the connector housing main body in a direction intersecting an inserting direction of the terminal, has a temporarily engaging unit which is temporarily engaged with the housing main body under an inserted state and a mainly engaging unit which is mainly engaged with the connector housing main body, has terminal insert holes corresponding to the terminal insert holes of the connector housing main body and has a mainly terminal engaging part which permits the terminal to be inserted into the terminal insert hole at a temporarily engaged position where an insertion to the spacer insert recessed part is shallow and is mainly engaged with the terminal at a mainly engaged position where an insertion to the spacer insert recessed part is deep to prevent the terminal from moving forward and backward, in the spacer, the lance is integrally provided as a temporarily terminal engaging unit that is temporarily engaged with the terminal when the terminal is inserted into the terminal insert hole from a rear part under a state that the spacer is located at the temporarily engaged position, the mainly terminal engaging part is provided, in an inner periphery of the terminal insert hole of the spacer, as an engaging protrusion part fitted to an engaging recessed part of the terminal side at a position of a front side of the inserting direction when the spacer is inserted into the spacer insert recessed part, an engaging edge part of the engaging protrusion part is provided as an edge part substantially parallel to a direction orthogonal to the inserting direction of the spacer, the lance is arranged, in the inner periphery of the terminal insert hole of the spacer, at a position shifted from a position of a front surface opposed to the engaging protrusion part in an oblique direction seen from a central part of the terminal insert hole, a bending direction of the lance is set to a direction substantially corresponding to the oblique direction, an engaging edge part of the lance fitted to the engaging recessed part of the terminal side is provided as an edge part orthogonal to the bending direction of the lance, the terminal is formed as a round terminal having a cylindrical electric connecting part fitted and connected to a terminal of a mate connector side, in a rear part of the cylindrical electric connecting part of the round terminal, an engaging part is provided that is engaged with the lance and the engaging protrusion part and positions a rotating direction of the terminal during a process of engagement, in a further rear side, an electric wire connecting part is provided to which a terminal of a coated electric wire is connected, the engaging part of the terminal includes an engaging recessed part formed by recessing two opposed surfaces of a cylindrical periphery wall forming the electric connecting part substantially by the same dimension and a rotating direction position control part with a substantially rectangular shape in section having, as short sides, the cylindrical periphery wall remaining at a position where the engaging recessed part is formed and, as long sides, an inner bottom surface of the engaging recessed part, the engaging recessed part is provided to which the engaging edge part of the lance and the engaging edge part of the engaging protrusion part of the spacer are fitted to prevent the terminal from moving forward and backward, the rotating direction position control part is provided to apply a rotation for controlling a position in a rotating direction to the terminal by a rotation moment generated by a contact pressure when the engaging edge part of the lance and the engaging edge part of the engaging protrusion part of the spacer are pressed to come into contact therewith, and at least one end part of the engaging edge part of the engaging protrusion part of the spacer, an oblique cut-out part is provided to form an inclined surface that inclines a direction of force when the contact pressure is applied to the rotating direction position control part relative to the inserting direction of the spacer.

2. The connector according to claim 1, wherein many terminal insert holes of the connector housing are arranged in the vertical direction and the transverse direction of the connector housing, the spacer insert recessed part of the connector housing main body is formed in such a direction as to insert the spacer upward from a lower surface of the connector housing main body, in each of the terminal insert holes of the spacer, the engaging protrusion part is arranged in a lower side and the lance is arranged in an obliquely upper position in the inner periphery of the terminal insert hole, and the inclined surface is formed in at least one end part in the transverse direction of, the engaging edge part of the engaging protrusion part of the spacer.

3. The connector according to claim 2, wherein when the arrangement of the engaging edge parts of the terminal insert holes in the transverse direction is referred to as a line, the terminal insert holes are arranged with pitches fixed between the lines in the vertical direction and linearly arranged with the fixed pitches in the transverse direction in each of the lines in the vertical direction, and between the adjacent lines in the vertical direction, positions of the terminal insert holes are shifted by 1/integer times as long as an arrangement pitch in the transverse direction.

* * * * *